US011261682B2

(12) United States Patent
Angman et al.

(10) Patent No.: US 11,261,682 B2
(45) Date of Patent: Mar. 1, 2022

(54) MODE SELECTOR FOR A DOWNHOLE TOOL

(71) Applicant: KOBOLD CORPORATION, Calgary (CA)

(72) Inventors: Per Angman, Calgary (CA); Matthew Brown, Calgary (CA); David Parks, Calgary (CA); Allan Petrella, Calgary (CA); Mark Andreychuk, Calgary (CA)

(73) Assignee: KOBOLD CORPORATION, Calgary (CA)

( * ) Notice: Subject to any disclaimer, the term of this patent is extended or adjusted under 35 U.S.C. 154(b) by 90 days.

(21) Appl. No.: 16/518,977

(22) Filed: Jul. 22, 2019

(65) Prior Publication Data

US 2020/0024917 A1 Jan. 23, 2020

Related U.S. Application Data

(60) Provisional application No. 62/700,970, filed on Jul. 20, 2018.

(51) Int. Cl.

| | |
|---|---|
| ***E21B 23/00*** | (2006.01) |
| ***E21B 44/00*** | (2006.01) |
| ***E21B 34/14*** | (2006.01) |

(52) U.S. Cl.
CPC ..... *E21B 23/006* (2013.01); *E21B 34/14* (2013.01); *E21B 44/005* (2013.01)

(58) Field of Classification Search
CPC ..... E21B 23/004; E21B 23/006; E21B 34/14
See application file for complete search history.

(56) References Cited

U.S. PATENT DOCUMENTS 5,311,939 A * 5/1994 Pringle ..... E21B 33/1292 166/134

FOREIGN PATENT DOCUMENTS

CN 201112876 Y * 9/2008

* cited by examiner

*Primary Examiner* — Cathleen R Hutchins
*Assistant Examiner* — Ronald R Runyan
(74) *Attorney, Agent, or Firm* — Parlee McLaws LLP; Andrew C. Lau

(57) ABSTRACT

Embodiments herein relate to apparatus for selecting between direct manipulations of a downhole tool and shifting of the operational mode of a downhole tool, and more particularly to a mode selector tool coupled with a J-Slot mechanism for the downhole tool, the selector enabling either an unimpeded shifting of, or a locking, of the J-Slot mechanism and connected downhole tool.

12 Claims, 22 Drawing Sheets

RIH / LOC TP LP RS

SET TIMER TP LP RS

LOCKED TP LP RS

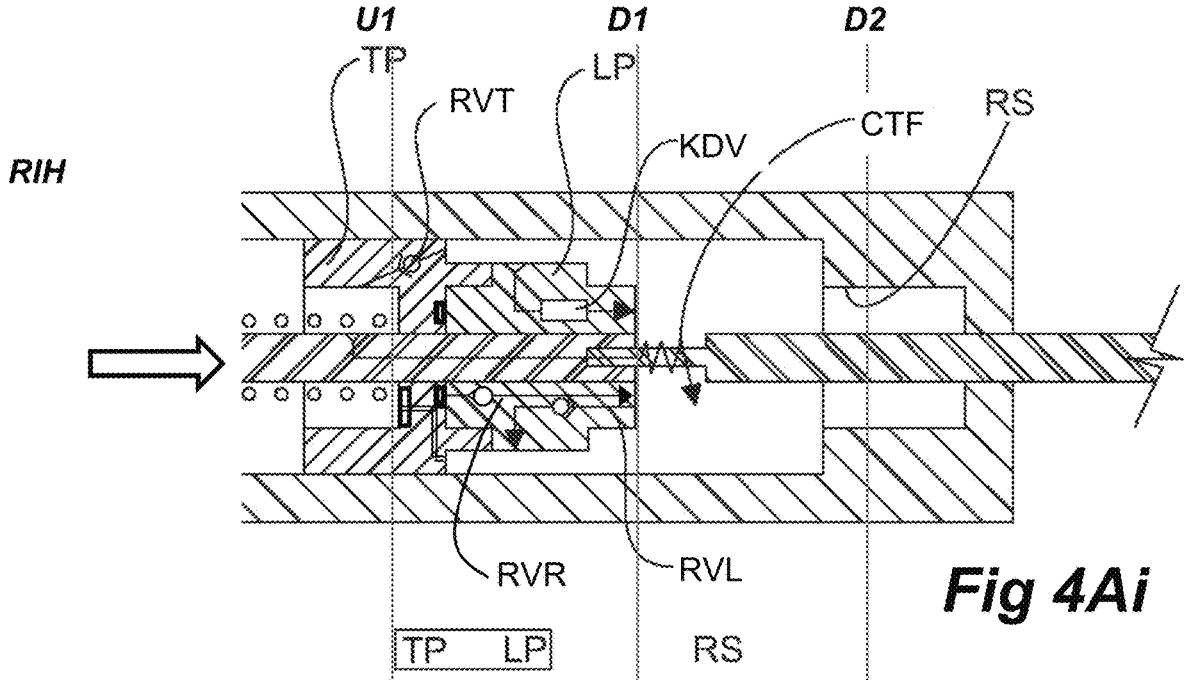
Fig 4Ai
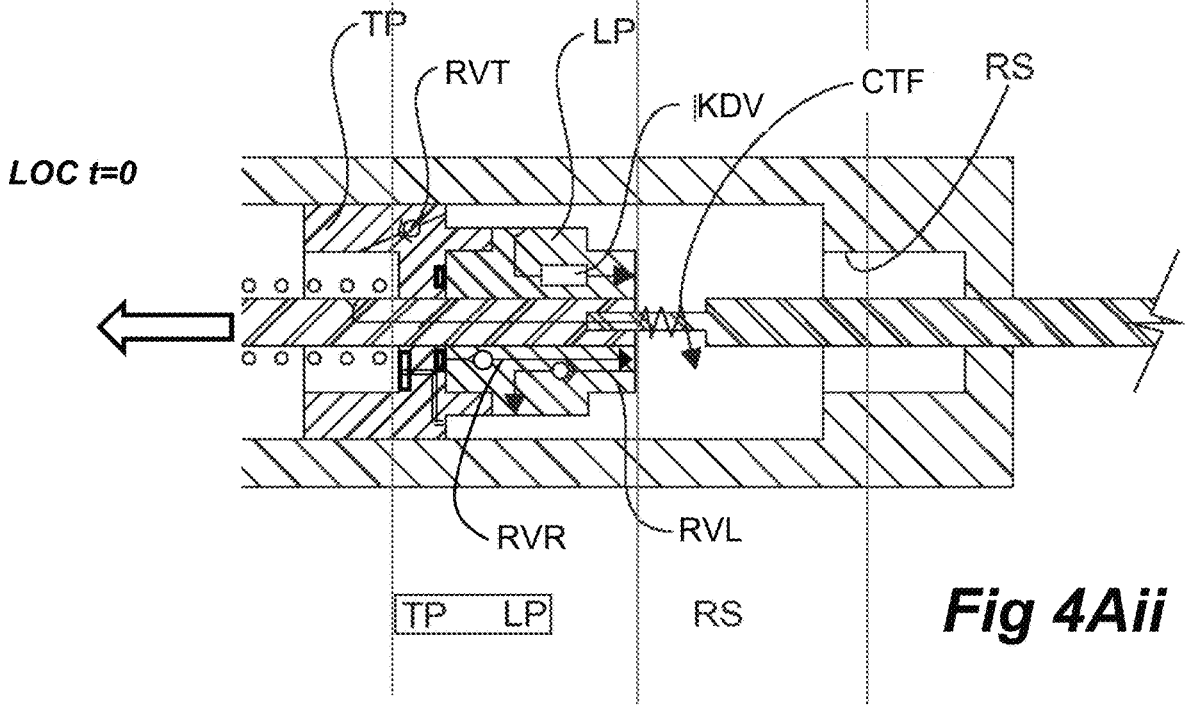
Fig 4Aii

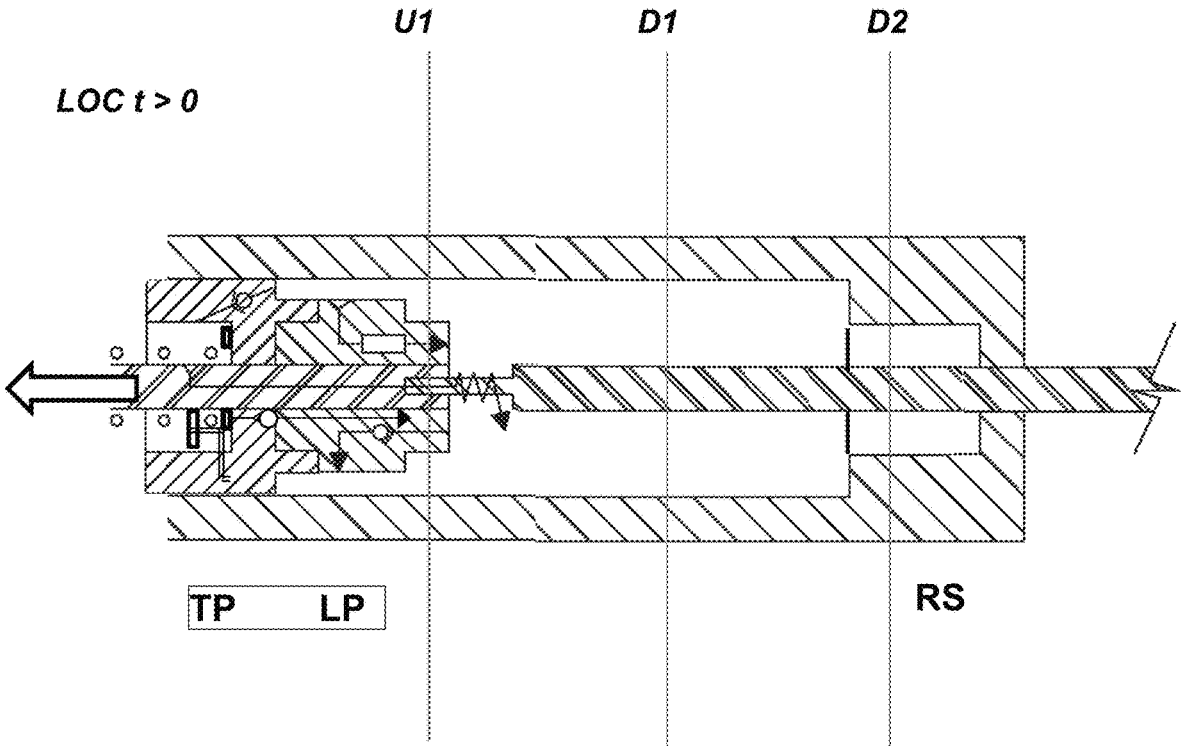
Fig 4Aiii

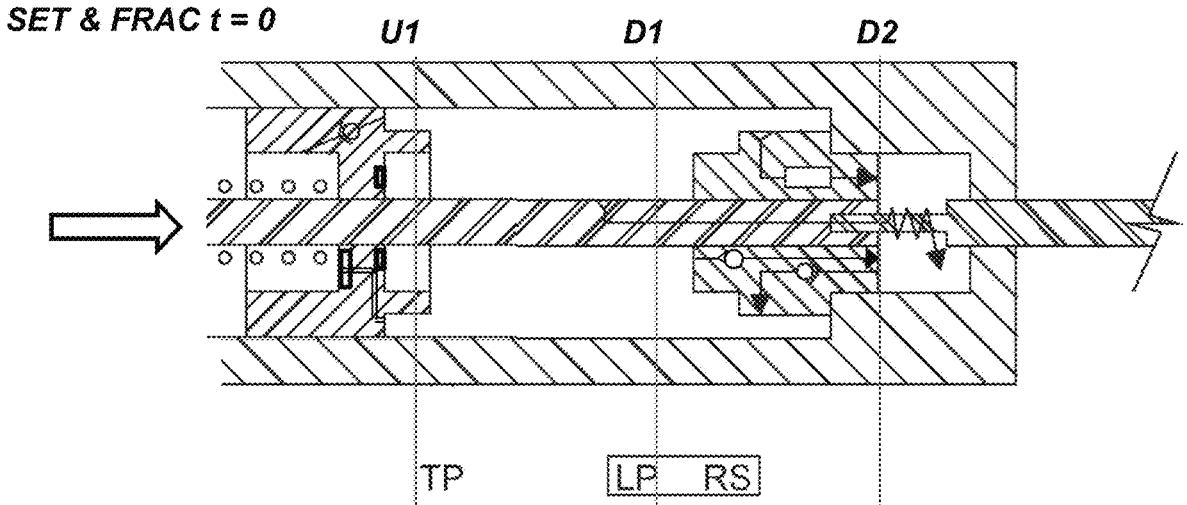
Fig 4Bi
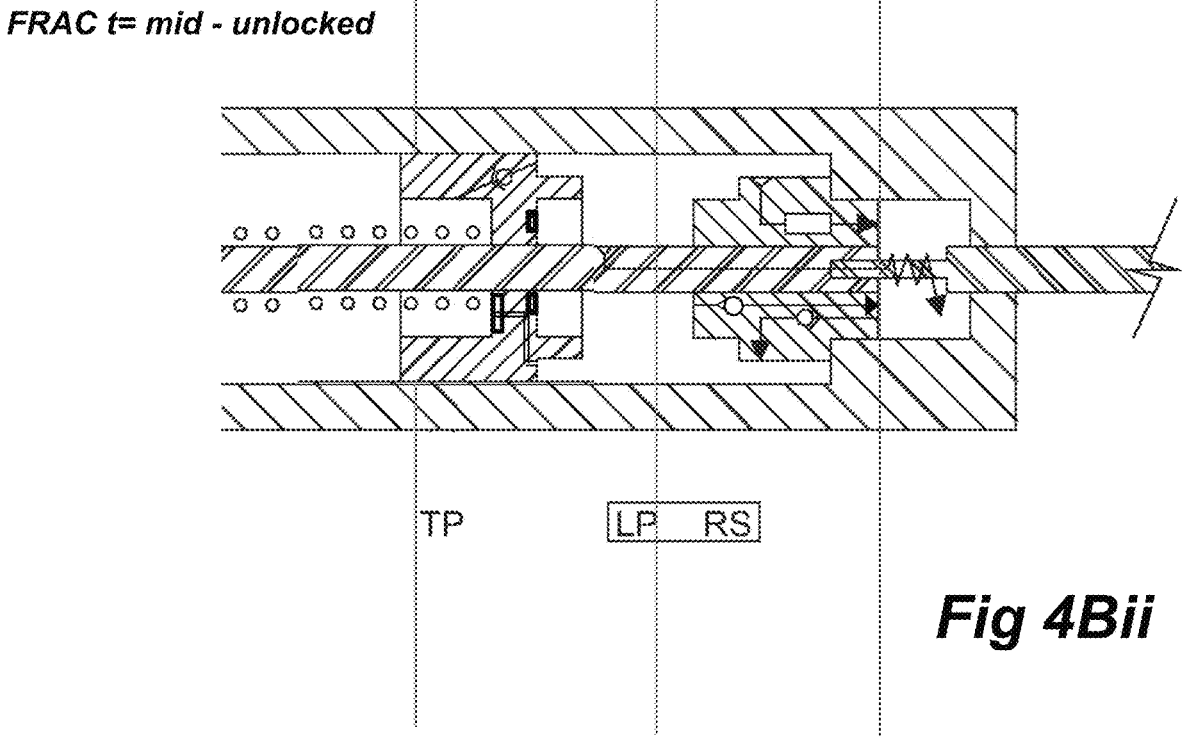
Fig 4Bii

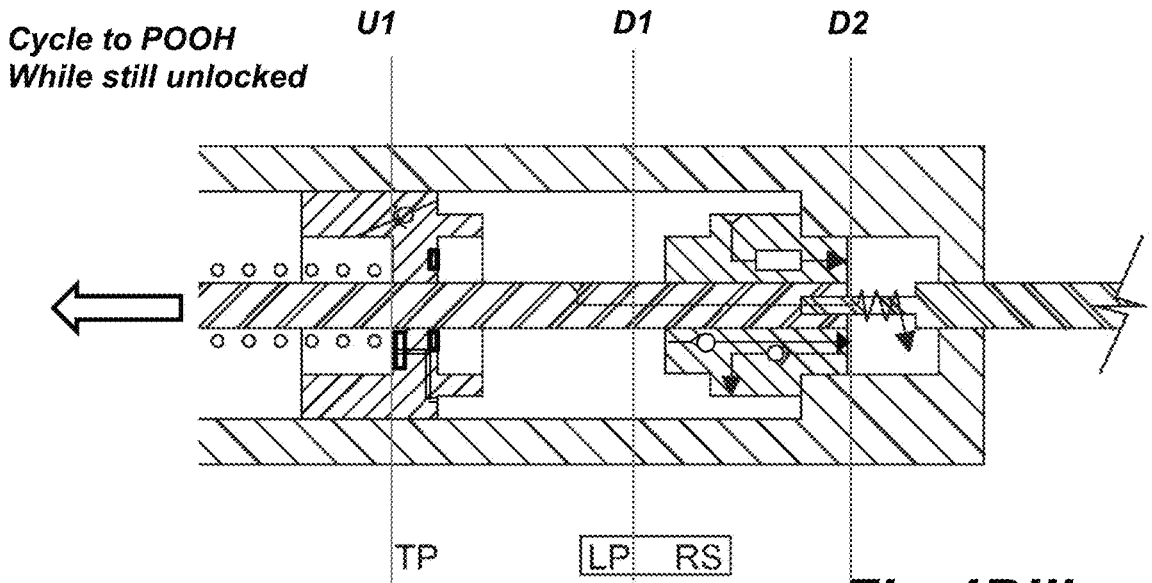
Fig 4Biii
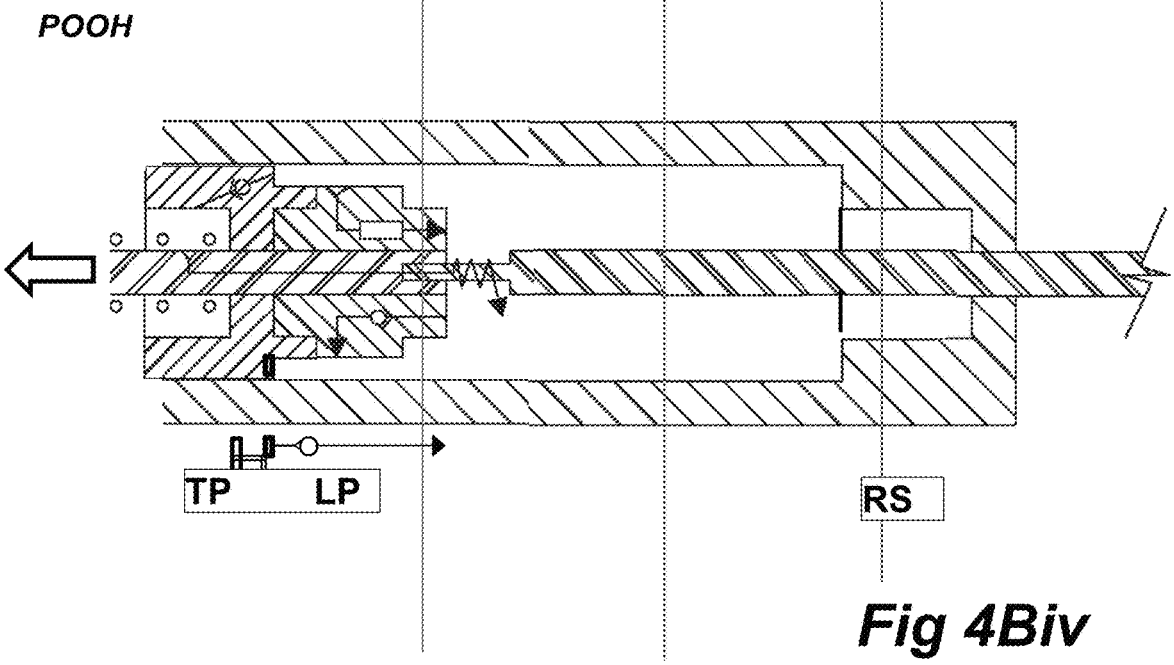
Fig 4Biv

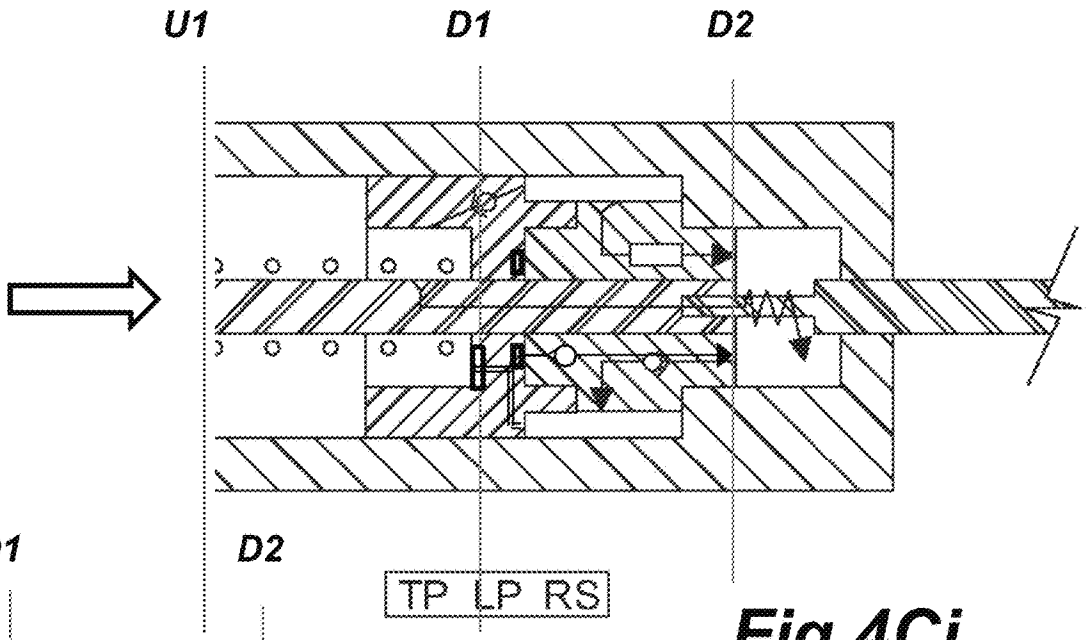
FRAC t=max - locked
Fig 4Ci
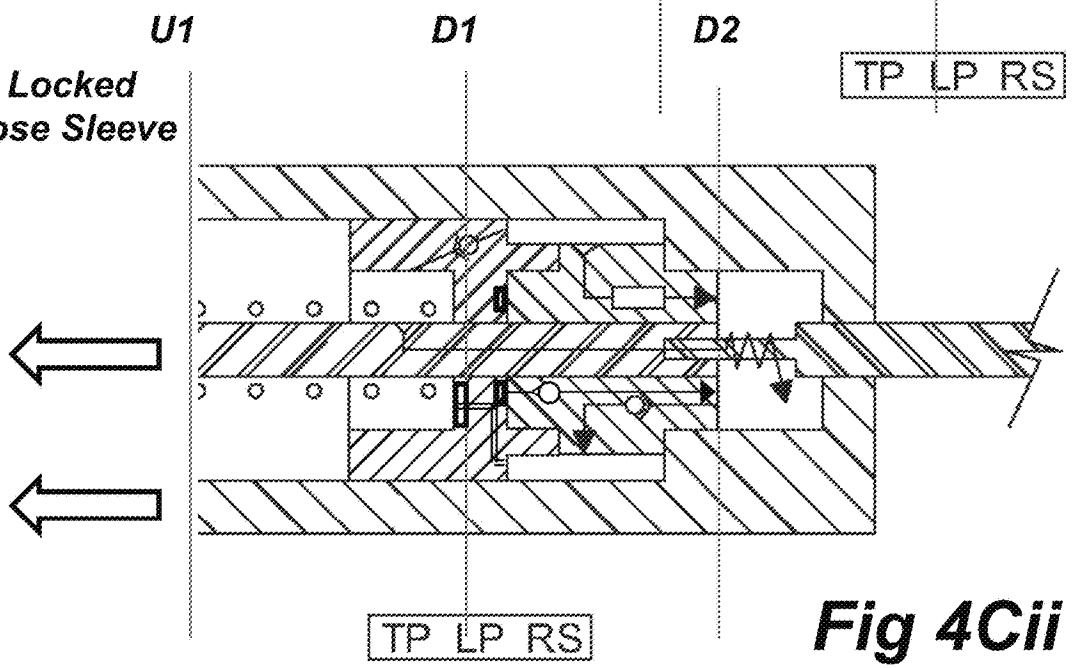
SET – Locked
To Close Sleeve
Fig 4Cii

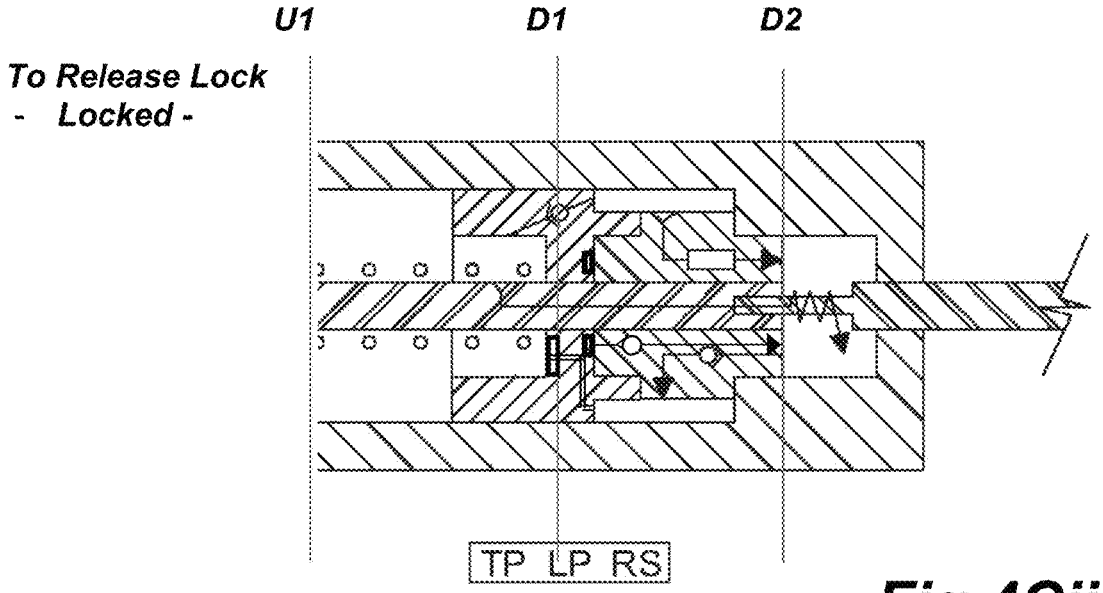
Fig 4Ciii
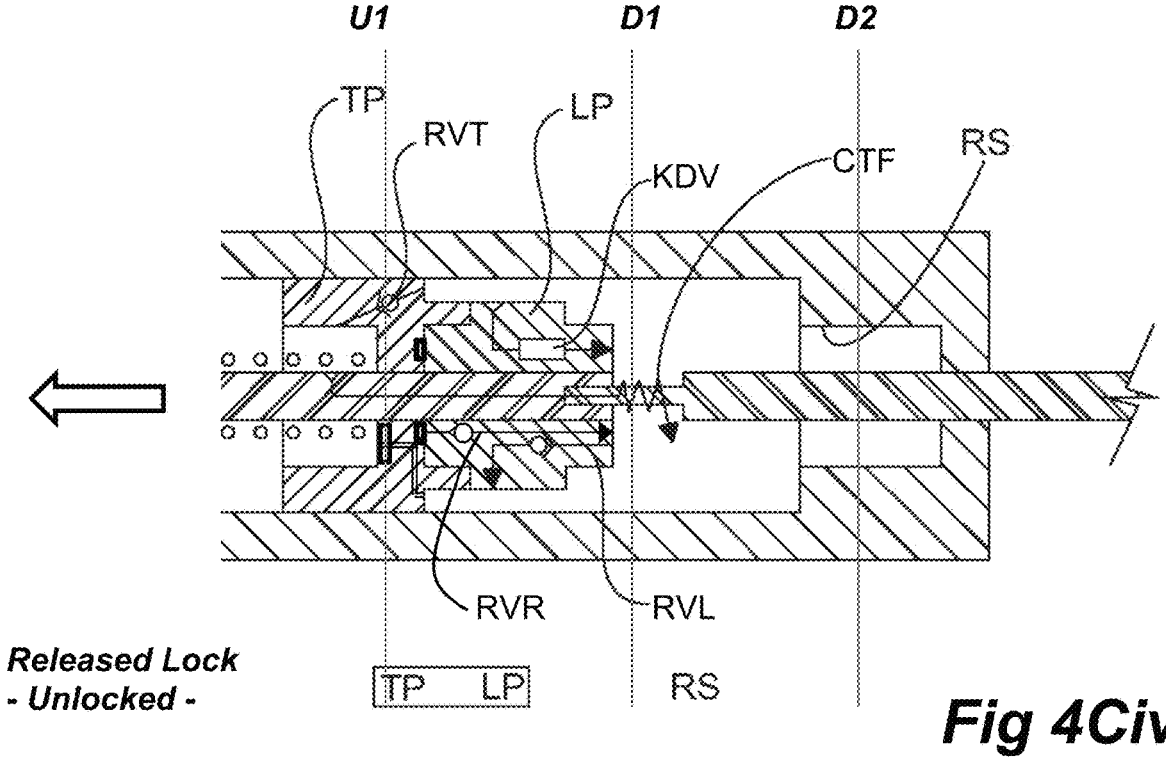
Fig 4Civ

CT CYCLES= 5

CT CYCLES= 2

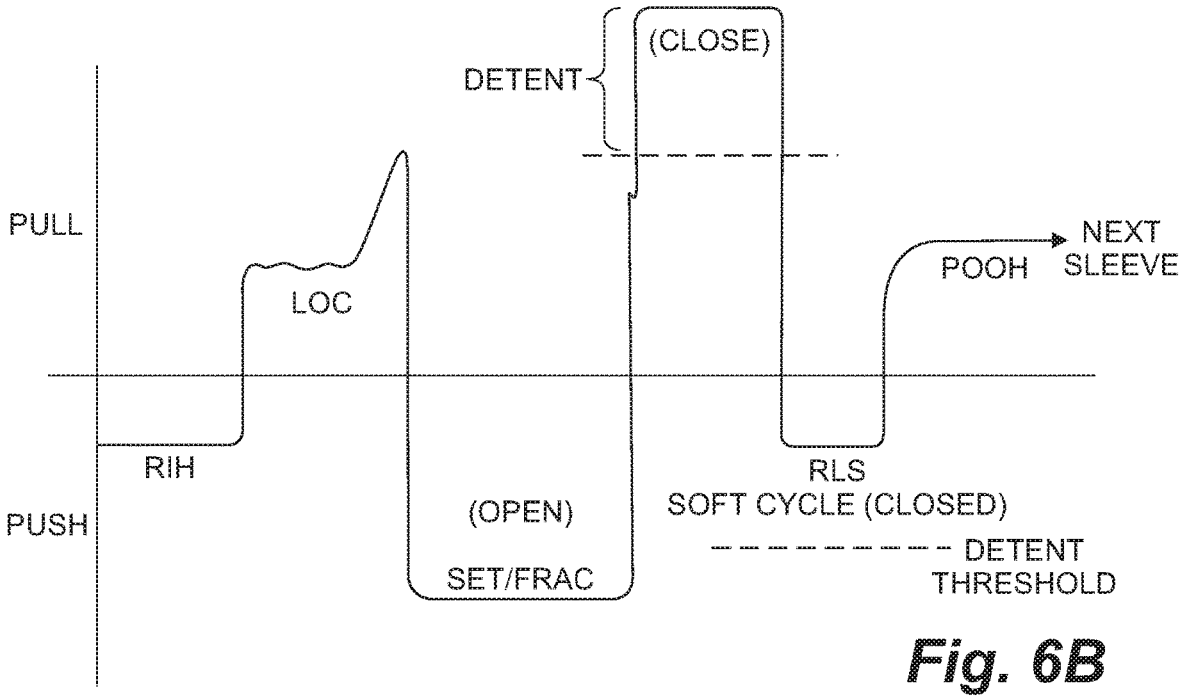
Fig. 6B
PRIOR ART
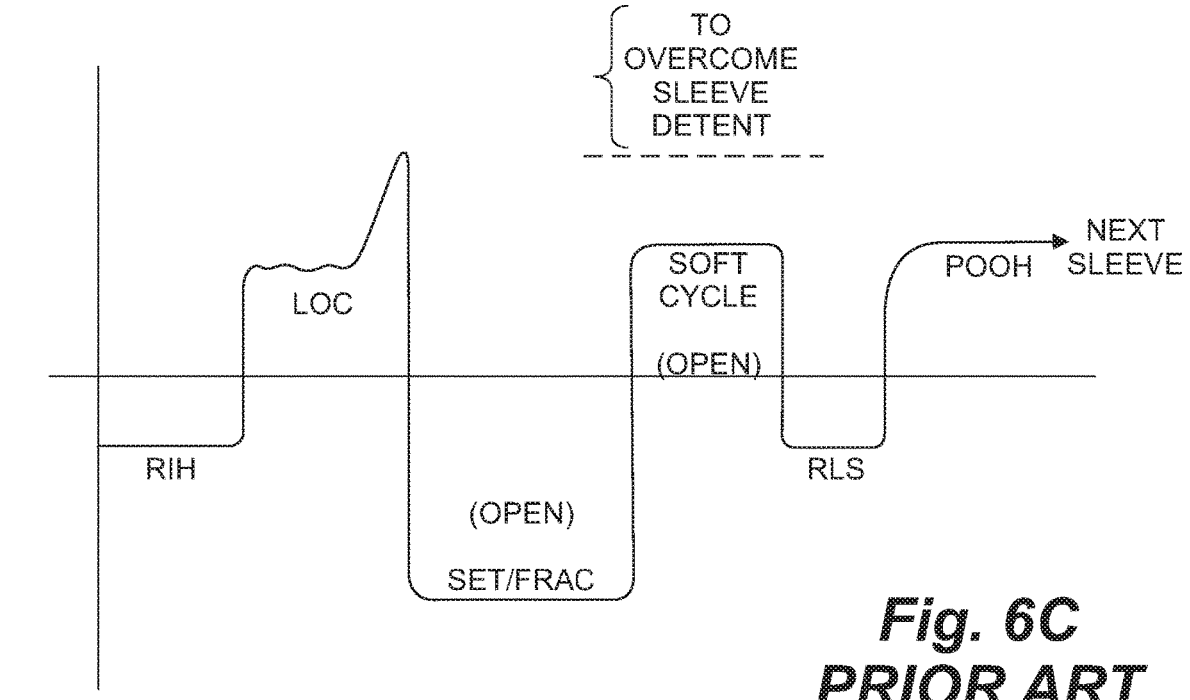
Fig. 6C
PRIOR ART
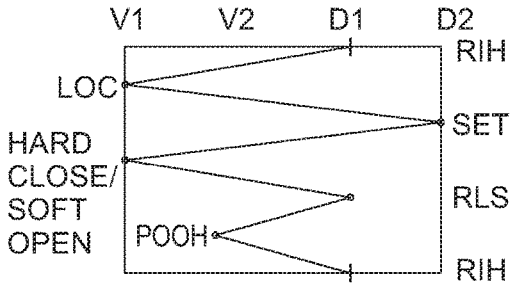

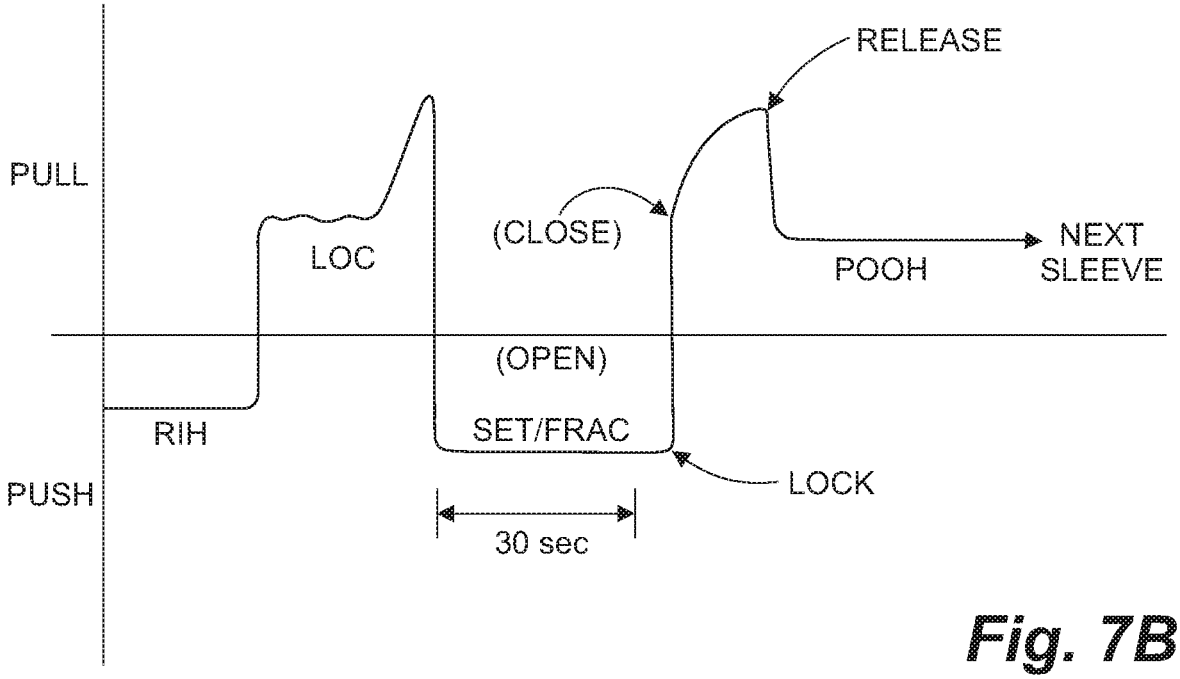
Fig. 7B
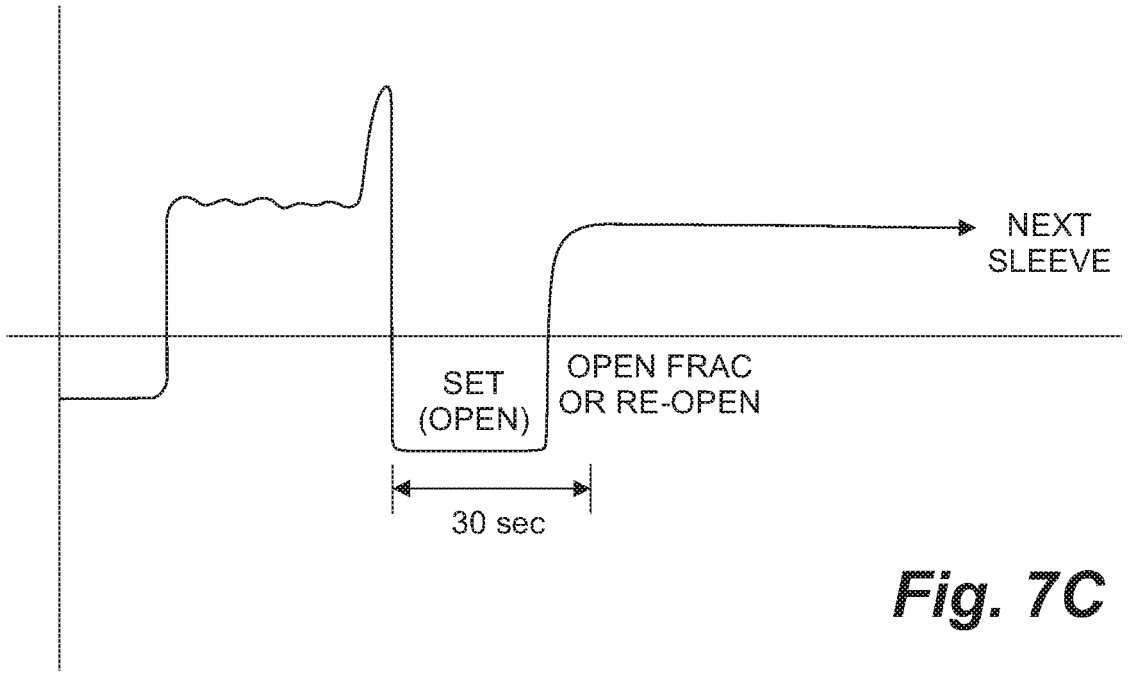
Fig. 7C
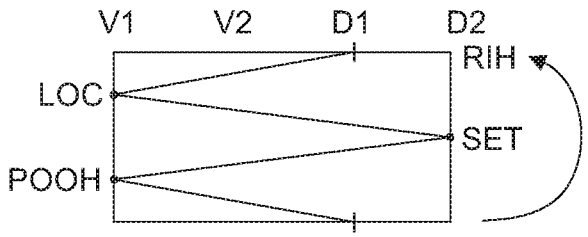

MODE SELECTOR FOR A DOWNHOLE TOOL

FIELD

Embodiments herein relate to apparatus for selecting between direct manipulations of a downhole tool and shifting of the operational mode of a downhole tool, and more particularly to a mode selector tool coupled with a J-Slot mechanism for the downhole tool, the selector enabling either an unimpeded shifting of, or a locking, of the J-Slot mechanism and connected downhole tool.

BACKGROUND

A variety of downhole tools in a wellbore utilize uphole and downhole cycling of the conveyance string to change the operation of the tool. A J-Slot mechanism (J-SLOT) is often used in combination with, or incorporated within the downhole tool. As currently defined by the Schlumberger Oilfield Glossary, a J-mechanism is commonly used in the setting and unsetting of downhole tools and equipment such as packers. Most conventional downhole tools operate by upward or downward movement, rotation, or a combination of both. A J-slot profile creates the track for an actuating cam or pin that combines rotation and up or down movement to provide a simple yet reliable means of shifting the operational mode of a tool.

The technology has many implementations including downhole tools such as packers and many other tools including sleeve valves in well completion strings. Such J-Slot mechanisms comprise a J-Slot Mandrel connected to the conveyance string and axially shiftable within a housing. A pin guided by the J-slot slot or profile enables several modes dictated by the profile's relative uphole and downhole positions. Typically the conveyance string is connected for up and down movement of the J-Slot Mandrel through a relatively stationary housing having the profile supported therein. Like a cam and follower, the pin moves uphole and downhole in the profile through relative axial movement of the mandrel through the housing.

Downhole tools, located a long distance downhole, are operated using a simple up and down movement of the conveyance string. The conveyance string is manipulated axially up and down from surface resulting in uphole and downhole movement of the mandrel. The J-SLOT, and like connected downhole tools such as shifting tools, simply respond to adjust the relative axial position of the tool components; pulling up of the conveyance string resulting in the mandrel moving uphole of the housing and setting down resulting in the mandrel shifting downhole relative to the housing. The effect on the connected tool is to be similarly shifted.

The conventional J-SLOT has been used for simple and reliable up and down indexing for tools in various alternating and continuous modes for over 70 years, applied to overshot tools, packers, retrievable bridge plugs, actuating tools for downhole sleeves and the like.

However, the range of surface control of such tools is often limited by mere up and down movement of the conveyance string.

There is interest in the industry for adding a level of sophistication to the up/down modes of operation of a J-Slot operated tool and operational improvements related thereto.

SUMMARY

A mode selector tool is provided for coupling with downhole tools such as bottomhole assemblies (BHA) including those shiftable between two or more modes of operation, the tools actuatable by an uphole position and a downhole position. A BHA is typically run into casing or other tubular. The BHA may be used for manipulating other downhole tools, such as the sleeves of sleeve valves spaced along a tubular or completion string extending along a wellbore.

A problem with sleeve valves and J-SLOTs is that once the BHA has been axially shifted to opened or close a sleeve, a cycling of the J-SLOT to another mode, such as to configure the downhole tool for running in, or out of hole, could accidentally undo the prior operation, closing an opened valve or opening a closed valve. Herein, the mode selector permits, for example, the operator to use the downhole tool engage and open a sleeve, and then deliberately actuate the J-Slot Mandrel to operate along the J-Profile to disengage the sleeve or, alternatively, to lock the pin in the J-Profile and directly actuate the J-Slot Mandrel while locked in the J-Profile to further manipulate the engaged sleeve, including to re-close the just-opened sleeve.

In one aspect, the mode selector is a component to selectively hinder the J-slot operation at one or more positions of the J-SLOT cycle so as add modes of operation to the BHA. One mode is the usual passive operation and free cycling of the J-SLOT, where the BHA is basically passive whilst the conveyance string or CT is axially manipulated to cycle the J-SLOT. Another mode is to actively to lock the J-SLOT against cycling, forcing the BHA to move with the axially actuation of the conveyance string.

The mode selector comprises a component that temporarily locks the J-Slot Mandrel to the J-Slot Housing or J-Profile. This can be a fluid-coupled device that hydraulically locked the two together and which is released through fluid timing and various release mechanisms. One such fluid device includes metering orifices for timing, and valves for locking and release. Electrical timers and actuators can be employed if there are electrically enabled actuators and electrical communication to surface or through remote devices.

In a general aspect, a mode selector tool for use with a downhole sleeve-shifting tool comprising a J-slot housing and a mandrel extending along the J-slot housing and movable axially therethrough, the J-slot mandrel having a pin for following a J-profile, is provided, said mode selector comprising: a tubular selector housing having first and second ends and adapted at its first end to couple to the J-slot housing; a selector mandrel extending into the selector housing at its first end, said selector mandrel adapted at its first end to couple with the J-slot mandrel so as to move therewith; and a mode controller assembly which, when actuated, controls the axial movement of the selector mandrel so that it may move freely or so it is temporarily locked in place.

In an embodiment, the selector housing forms a sealed chamber for containing a body of hydraulic fluid.

In an embodiment, the mode selector utilizes a time delay to determine whether the selector mandrel moves freely or is temporarily locked in place.

BRIEF DESCRIPTION OF THE DRAWINGS

FIG. 4A illustrates free downhole (rightward) and uphole (leftward) axial movement of the selector mandrel relative to the selector housing;

FIG. 4B illustrates initiation of a locking timer after which further movement of the selector mandrel and downhole tool associated therewith, whether the movement is free or locked, is dependent on a time delay;

FIG. 4C illustrates the selector mandrel locked to the selector housing;

FIGS. 4Ai,4Aii, 4Bi, 4Bii and 4Ci,4Cii are close up mechanical schematic representations and fluid movement for the respective mode selectors of FIGS. 4A, 4B and 4C, more particularly:

FIG. 4Ai illustrates free downhole (rightward) axial movement of the selector mandrel in RIH mode;

FIG. 4Aii illustrates the slow uphole (leftward) axial movement of the selector mandrel upon initiation or early in the LOCATE mode;

FIG. 4Aiii illustrates the uphole axial movement of the selector mandrel after some time wherein the J-Slot axial travel in LOCATE mode has stopped or limited by the J-Profile;

FIG. 4Bi illustrates free downhole (rightward) axial movement of the selector mandrel using SET MODE;

FIG. 4Bii illustrates the slow downhole (rightward) axial movement of the timing piston towards the locking piston during the frac;

FIG. 4Biii illustrates an optional free uphole axial movement of the timing piston before the timing piston reaches the locking piston after the frac;

FIG. 4Biv illustrates the selector mandrel and J-Slot Mandrel reaching the top of the J-Profile for actuating the POOH mode;

FIG. 4Ci illustrates a locked timing or travelling piston after the time delay exceeds the timing threshold, the travelling piston and locking piston coupled and engaging the receiving socket for enabling BHA movement without cycling the J-SLOT;

FIG. 4Cii illustrates BHA manipulation without J-slot cycling, such as to shift an opened sleeve from open to closed, for example while a BHA latches remain set in a sleeve recess;

FIG. 4Ciii illustrates commencement of a forcible release of the locking piston from the receiving socket for resumption of free J-SLOT cycling;

FIG. 4Civ illustrates successful release of the locking piston from the receiving socket;

FIG. 4Cv illustrates the selector mandrel and J-Slot Mandrel reaching the top of the J-Profile for actuating the POOH mode;

FIG. 5A illustrates the steps for selecting a J-SLOT operation for the downhole tool, firstly for running in hole (RIH), pulling uphole to locate a sleeve, setting down to open the located sleeve and, before the mode selector time delay expires, pulling up again to move the downhole tool uphole to the next sleeve valve;

FIG. 5B illustrates the steps for selecting a J-SLOT operation for running in hole (RIH), pulling uphole to locate a sleeve, setting down to open the located sleeve and, after the mode selector time delay expires to lock the J-SLOT, pulling up again to close the previously-opened sleeve, then releasing the mode selector to permit the J-SLOT to shift the downhole tool uphole to the next sleeve valve;

FIG. 5C illustrates the steps for selecting a J-SLOT operation for running in hole (RIH), pulling uphole to locate a sleeve, setting down to open the located sleeve and, performing a pressure test with the sleeve open, thereafter if the production pressure from that zone is acceptable and before the mode selector time delay expires, pulling up again to move the downhole tool uphole to the next sleeve valve or, if the pressure is not acceptable then, after the mode selector time delay expires, pulling up again to close the previously opened sleeve to block the bad zone;

FIG. 6B is a chart to illustrate the surface CT weight for the various steps in Applicant's own PRIOR ART 6-cycle prior art BHA apparatus to open then close a sleeve valve, namely to set down RIH, pull LOCATE mode, SET mode to open a sleeve and frac, then pulling at high force to overcome the sleeve retention detents to close the sleeve, set down for a soft cycle (less than the open detent actuating force); and pull up to POOH mode for moving to the next uphole sleeve;

FIG. 6C is a chart to illustrate the surface CT weight for the various steps in Applicant's own PRIOR ART 6-cycle prior art BHA apparatus to open then maintain the sleeve in the open condition, namely to set down RIH, pull LOCATE mode, SET mode to open a sleeve and frac, then pulling at a soft-cycle force to prevent release ofhte sleeve retention detents, then set down to cycle the J-SLOT; and pull up to POOH mode for moving to the next uphole sleeve;

FIG. 7B is a chart to illustrate the surface CT weight for the various steps in an embodiment of Applicant's current 4-cycle BHA apparatus to open then close a sleeve valve, namely to set down RIH, pull to LOCATE mode, SET mode to open a sleeve and frac and permit expiry of the delay threshold to lock the mode selector, then pulling to close the sleeve, pulling even harder to release the mode selector, and finally to pull up to POOH mode for moving to the next uphole sleeve;

FIG. 7C is a chart to illustrate the surface CT weight for the various steps in an embodiment of Applicant's current 4-cycle BHA apparatus to open a sleeve valve, namely to set down RIH, pull to LOCATE mode, SET mode to open a sleeve and frac, or re-open a previously closed sleeve, and before expiry of the delay threshold to maintain free J-SLOT movement, pulling up to POOH mode for moving to the next uphole sleeve;

FIG. 11A illustrates running the shifting tool to the toe and configuring the mode selector for performing sequential operations of opening a sleeve, fracturing the zone and closing the sleeve before moving uphole, such operations permitting healing of the fractured zones before production, the closing of the sleeves utilizing the J-SLOT locking feature of the mode selector;

FIG. 11B illustrates running the shifting tool to the toe and configuring the mode selector for performing sequential operations of re-opening each sleeve before moving uphole, such operations permitting configuring previously fractured zones for production;

FIG. 11C illustrates running the shifting tool to the toe and configuring the mode selector for performing sequential operations of opening each sleeve before moving uphole, checking for formation pressure performance from that zone and using the locking function of the mode selector for closing non-performing zones;

DESCRIPTION OF THE PREFERRED EMBODIMENTS

Figure 1:
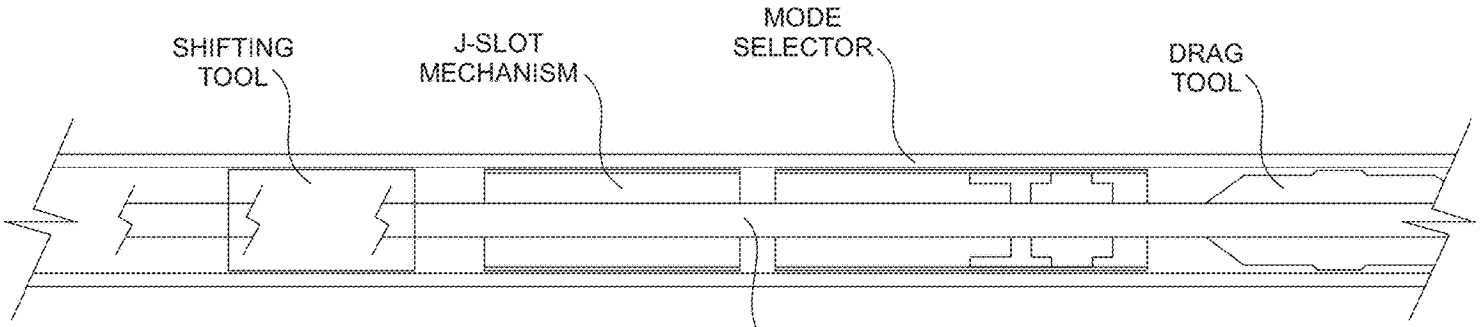
FIG. 1 is a schematic representation of a downhole tool having a axial mode shifting mechanism fit with an embodiment of the current mode selector.

A mode selector device is provided for modifying the conventional operation of an axially manipulated J-slot device for shifting the operations of a connected tool.

Conveniently the operation of a Bottom Hole Assembly (BHA) is described herein for manipulating sleeve valves spaced along a wellbore, such as a completion string.

In the conventional operation, operation of the BHA results in limited operations and a significant number of stress cycles of the actuating conveyance string such as a coiled tubing (CT)

The conveyance string is used to cycle a J-SLOT provide as part of, or as an appendage to, the BHA. The BHA and the conveyance string are run-in-hole (RIH) downhole along the wellbore to position the BHA below a sleeve. The conveyance string is pulled uphole while J-Slot sets the BHA to a locate mode (LOCATE) to locate the sleeve. Once the sleeve is located the BHA and J-slot are set downhole again actuating the BHA to a set mode (SET) for engaging the BHA with the sleeve and driving the sleeve downhole to expose ports uphole of the shifted sleeve and thereby open the sleeve valve to the formation outside the completion string. The open ports are suitable for delivering hydraulic fracturing fluids to the formation.

After the frac operation is complete the conveyance string is pulled uphole so that the J-Slot sets the BHA to pull-out-of-hole (POOH) mode and the BHA is configured to be pulled-out-of-hole, either completely or most often merely pulled uphole to the next sleeve.

Similarly, actions can be taken to close the sleeve, typically through increased complexity of the BHA and manipulation of the J-SLOT including setting the BHA for both opening and then closing operation. Depending on the engagement of the BHA and sleeve, a simple uphole and downhole manipulation of the J-SLOT cannot successfully change the operation of the downhole tool, or release the engagement interface between BHA and sleeve.

A typical BHA, including the shifting tool for a sleeve valve in a fracturing completion string, comprises a sleeve-engaging element, and a seal. The sleeve-engaging element is manipulated to engage the sleeve, for axial opening and closing thereof, and disengaged for repositioning of the BHA.

The seal fluidly isolates the wellbore below a selected sleeve valve to enable high pressure fracturing fluids to be selectively delivered through the open sleeve valve and not escape to the wellbore or sleeve valves therebelow. The seal is often configured like a retrievable bridge plug, having slips for gripping the completion string, a cone for activating the slips and an expandable packer.

The J-Profile of the J-SLOT typically has an intermediate downhole run-in-hole (RIH) position in which the cone is spaced from the slips for enabling free movement along the casing. The J-Profile further includes an uphole (LOCATE) position often used to enable or actuate the BHA to locate the sleeve. A fully downhole set (SET) position enables operative engagement of the located sleeve for downhole opening thereof and typically includes actuation of the cone and slips, locking the BHA to the casing and activating the packer for the fracturing procedure. Once fracturing at that sleeve valve is complete a further uphole pull-out-of-hole (POOH) position is accessed to release the slips and packer for enabling re-positioning of the BHA, such as to another sleeve valve.

In more recent operations, an operator is interested in closing the open sleeve valve after fracturing to permit the fractured formation to rest or heal, and prevent sand/proppant from reentering the wellbore. After all stages accessed by the sleeve valves have been opened, fractured and closed, the BHA is run downhole once again to reopen each sleeve valve for production.

The BHA, depending on the type used, may be limited in its ability to perform sequential operations for first opening a sleeve of a sleeve valve, perform fluid fracturing, and immediately closing the sleeve before moving to the next sequential sleeve valve to repeat the open, frac and close steps.

The BHA mechanism to both open and close a sleeve valve up to kilometers downhole, using up and downhole movement of the conveyance CT from surface, is non-trivial. To date, Applicant is aware of BHA tools having all of a positioning, opening and closing sequence, useful for the initial actuating of the completion string by opening a sleeve, fracturing and closing the sleeve immediately thereafter, such as for flow testing, and even opening a closed sleeve once again after establishing the productivity of the fractured zone.

In one form of known tool, when the BHA tool is run back downhole to reopen all the sleeves for production, the tool is not equipped to close a sleeve ad hoc, such as a sleeve valve positioned at a negatively performing stage in the formation. If a particular sleeve valve is to be closed after re-opening, the BHA must be retrieved to surface and reconfigured one time for closing that sleeve, but is then no longer capable of re-opening sleeves. The BHA must then be pulled out of hole to be set up again for reopening sleeves, run in hole to the next sleeve and the re-opening is resumed.

For some sleeve profile and dog-engaging tools, such as Applicant's shifting tool as described in pending application published as US20170058644A1 on Mar. 2, 2017, the entirety of which is incorporated herein by reference, the limitations inherent in the mechanism of the J-Slot is also a challenge requiring a full cycling of the J-Profile and repositioning of the BHA. A latch or dogs is used for engaging a recess in the sleeve using the BHA to shift the sleeve. The limited operation of the BHA requires significant manipulation to reset the J-SLOT so as to release the latch from the recess before permitting a repositioning movement. Further to permit closing of a sleeve, the J-SLOT is provided with extra cycles to maintain the latch in engagement after setting, but then there is a need for soft cycling so as to release the latch without re-opening the sleeve e.g. cycling the BHA from the SET to POOH to RIH to LOCATE mode, pulling up in the LOCATE mode to close the sleeve, then soft setting the BHA to the SET mode without re-opening the sleeve and cycling again to POOH mode to move the BHA to the next sleeve uphole. This results in accidental shifting risk, significant time and added fatigue cycling of the conveyance CT.

For example, after a full cycle of the BHA, the CT is lowered downhole in the RIH mode, then the CT is pulled up for LOCATING the sleeve valve recess and then lowered again to SET the CT down to forcibly open the sleeve. Then it has been desirable to pull up on the CT to a POOH mode for disengaging the dogs from the sleeve profile and leave the sleeve open, or pull up on the CT to close the sleeve with the dogs still engaged. These are mutually exclusive actions. Thus, should the latch/dogs remain engaged with the sleeve's recess, either to release the BHA or in a further step to engage and close the just-opened sleeve valve, an additional J-Slot cycle is required which could accidently also shift the sleeve.

In several instances, if a sleeve is open, and the J-SLOT needs to be cycled with the latch engaged, there is a risk of closing the sleeve and vice versa, if the sleeve was closed, and the J-SLOT needs to be cycled with the latch engaged, there is a risk of re-opening the sleeve. This is an operation that risks shifting the sleeve. This cycling must be performed carefully in a SOFT-SET cycling operation, manipulating the CT forcefully enough to cycle the J-Profile but not so much as to release the sleeve from its temporary restraining detent of like restraint and accidentally reopening the sleeve.

If successful, the BHA's J-SLOT can be cycled and the BHA pulled uphole to the subsequent uphole sleeve.

In the SOFT-SET or SOFT CYCLE operations, the CT would be RIH with the sleeve in the re-closed position, and the BHA would be cycled without overcoming the "opening detent" in the sleeve where the J-SLOT actuates to POOH mode, then the BHAcan be POOH releasing the BHA from the sleeve so the BHA can be POOH to the next stage. If the SOFT-CYCLE was conducted with too much RIH or downhole force, where the BHA cycled and the sleeve "opening detent" was overcome, the sleeve would re-open requiring the entire process to be repeated. Typically accidental re-opening of the sleeve during a SOFT-CYCLE was monitored: by sensing the sleeve shift on the rig floor or in the control cabin of the CT rig at surface. Shifting of the sleeves generally has been detected by a shaking at the rig or other vibration detection. If a SOFT-CYCLE resulted in an accidental re-opening of the sleeve, detection was not clear at surface, the BHA would have to be cycled out of the current sleeve valve and the BHA would have to be set and sealed below the sleeve in blank casing to pressure test the well, and the sleeve in question, to confirm it is in fact "open" or "closed". The prior art BHA and operations, including Applicant's own system, were subject to these and various other disadvantages.

The time it took to disengage the BHA from a sleeve, cycle the BHA below the sleeve, relocate the sleeve, close the sleeve, and SOFT-CYCLE to get out was/is not acceptable because there is "risk" of inflow through a re-opened sleeve, which in most circumstances contains sand. Further, additional time was required if the initial SOFT-CYCLE re-opened the sleeve.

As stated, in more recent operations, after opening the sleeve, the BHA is used to close the sleeve after fracing. Contrary to the care required during cycling to avoid closing an opened sleeve, the BHA is well positioned to close a sleeve after opening it, as the latches/dogs are already engaged with the recess. However, to release the BHA from the sleeve risks re-opening the sleeve once closed. Extra J-Profile cycles are added and soft-cycle manipulation is required.

Using a 6-cycle J-Profile, the BHA is RIH, pulled up to locate the sleeve recess, then lowered to set and open the sleeve, such as for fracing in the first instance or later to re-open the sleeve. To close the sleeve, the 6-cycle J-Profile has a CLOSE mode, the CT pulled hard to overcome the sleeve restraint or detent, then lowered to a RLS of release cycle. As the latch is still engaged, this lowering step must be a soft-cycle to avoid re-opening the sleeve. The BHA is lowered downhole in a SOFT-CYCLE, to cycle the J-slot, yet not but aggressive not enough to re-open the sleeve.

The closed sleeve is typically retained in a closed position using some form of temporary retaining mechanism, such as a detent, which must not be overcome in cycling the J-SLOT. After a SOFT-CYCLE release cycle the BHA is pulled uphole to POOH mode to reposition the BHA at the next sequential sleeve valve to repeat the open, frac and close steps.

This operation increases the operational risk and adds time for opening and closing each sleeve valve and doubles tension/release cycles to the conveyance CT, negatively impacting the CT fatigue lifespan.

Using the same 6-cycle J-profile for merely opening a sleeve, the close mode is operated in a SOFT-CYCLE uphole pull at less than the sleeve restraint release force that would close the sleeve. Then again, to shift to POOH mode, the BHA is lowered downhole in RLS mode, but need not be a SOFT-CYCLE to cycle the J-slot, as the sleeve is already open. The BHA is then pulled uphole to POOH mode to reposition the BHA at the next sequential sleeve valve to repeat the open, frac and close steps.

Modification of a J-Slot Operation

As discussed above, a conventional J-SLOT comprises a J-Slot Mandrel axially shiftable within a J-Slot Housing. The J-Slot Mandrel is connected to a conveyance string extending downhole from surface for simple up and down actuation thereby. A pin is guided by the J-Profile, an axial portion of the profile providing different operating modes dependent upon the permitted axial travel of that portion of the J-Profile. Different axial stop positions equate to different operational modes of the downhole tool including to engage the BHA with a sleeve for shifting and to disengage the BHA and sleeve for repositioning purposes. The J-Profile forms a variety of uphole and downhole stops that can vary axially in length or the absolute position of the end-points or stops to dictate the different operations or phases of operation of the attached tools. The various axial portions of the J-Profiles are joined by generally circumferential-extending linking portions forming a continuous circumferential J-Profile.

Herein, the advantages of a mode selector are described in the context of Applicant's sleeve shifting tool as described in application published as US20170058644A1 on Mar. 2, 2017.

Each axial portion provides a different axial stop of the J-Profile. Typically the pin is mounted to the mandrel and the J-Profile is formed in the J-Slot Housing. Like a cam and follower, the pin moves freely uphole and downhole in the J-Profile through relative axial movement. Further, the associated tool and J-SLOT is generally tubular and thus lateral or circumferential shifting along the J-Profile results in a small differential rotation of the J-Slot Mandrel, the J-Slot Housing or both.

Typically the conveyance string is connected for up and down movement of the J-Slot Mandrel through a relatively, and axially-stationary, J-Slot Housing having the J-Profile supported therein.

Previously, each of the aforementioned up and downhole movements of the J-Slot Mandrel resulted in a new mode of operation.

To date, J-SLOTs have relied on free movement of the pin along the J-Profile in part due to the remote surface operation of the conveyance string for control of the modes of operation of a tool even kilometers downhole.

Herein, a mode selector tool is provided for interrupting the free cycling of the J-SLOT.

Mode Selector

The mode selector, through an override device, permits operation of the J-SLOT for conventional free up and down movement of the J-Slot Mandrel guided by the J-Profile.

A 4-mode J-Profile can be used for opening, closing and re-opening sleeves without reliance on operator skills in performing the prior soft-cycling type operations. The modes of the J-Profile are RIH, LOCATE, SET and POOH. Herein the SET operation can be manipulated to permit BHA movement without cycling the J-SLOT to the subsequent POOH mode, in certain circumstances The conventional J-Slot operation relies on up and down shifting of the CT to automatically cycle the BHA from mode-to-mode. However, the mode selector allows the automatic mode-to-mode operation to be arrested, at least temporarily, so that the connected mandrels and connected housings of the BHA and J-Slot can be axially locked together and manipulated as a unitary tool without cycling the J-slot.

The mode selector alters the freedom of movement of the J-SLOT between a free movement position and a restricted or locked position, either temporarily locked in the one of the uphole, or the downhole position. For operation of the J-SLOT, the terms "free movement" or "free" means generally unimpeded movement of the pin and connected mandrel along the J-Profile subject only to usual frictional considerations. In other words, a set down of the conveyance string or CT can still be associated with a cycling of the J-SLOT from U1 to D2 (SET) or to D1 (RIH) upon the latter of which the J-Profile is reset. Similarly, a pull up on the CT can still be associated with a shifting of the J-SLOT from D1 to U1 (LOCATE) or D2 to U1 (POOH).

The mode selector has a selector housing supported axially relative to the BHA, such as being coupled to the J-Slot Housing. The J-Profile is illustrated fancifully in rolled out view as having an intermediate downhole position D1 for RIH, an uphole position U1 for LOCATE, a fully downhole position D2 for SET and the uphole position U1 for POOH. The profile is continuous circumferentially about the J-Slot Housing, the up and down profile repeating once U2 shifts to D1.

Cycling of the J-slot at every uphole pull or downhole setdown of the CT limits the BHA functions and restrict flexibility in operations. Now, additional capabilities are possible with the mode selector including repeated opening and closing without wholesale switching of the BHA mode and downhole operations can be selected by need, including opening most sleeves but a few, rather than dictated by the running in hole or pulling out of hole stages of surface operations. For example, one can keep the BHA in the SET mode and pull up to close a recently opened sleeve immediately after fracturing.

In embodiments herein, the mode selector is described in the context of a BHA run in and out of a cased wellbore to open and close sleeve valves in a completion string of casing. The mode selector modifies the otherwise simple up and down operation of a "J" or J-SLOT of a BHA.

Herein, the BHA comprises an axial arrangement of components that extend generally co-axially with the wellbore casing including a sleeve engagement portion or shifting tool, a J-SLOT and a drag block. The drag block provides axial resistance to the J-Slot Housing to enable relative movement of the J-Slot Mandrel.

The BHA is configured for run-in-hole RIH mode for movement downhole through the wellbore casing and sleeve valves to the toe. Each sleeve valve comprises a tubular sleeve housing fit with a tubular sleeve. The sleeve has an inner and annular recess or dog-receiving sleeve profile formed intermediate along its length. The sleeve is shiftable downhole for opening ports uphole of an uphole end of the sleeve. The sleeve profile is annular and has a generally steep uphole shoulder interface for positive dog and sleeve profile locating purposes.

Applicant's shifting tool employs dogs for engaging the sleeve profile. The dogs are located at ends of radially controllable, and circumferentially spaced support arms are actuated radially inward to overcome biasing for either RIH and pull-out-of-hole POOH movement, and for releasing the arms radially for sleeve locating LOCATE and sleeve profile engagement SET. The dogs can be positively locked in the sleeve profile in the SET position for opening and closing with a locking wedge cone 34.

The shifting tool is manipulated to be restrained radially inwardly for RIH and POOH operations. The tool's dog and sleeve profile component eliminates the need for an independent location device such as a collar or sleeve end locator. An uphole shoulder of the dog is used to locate an upper shoulder of the sleeve profile for location purposes and for optional release, shifting uphole for re-closing or both. There is no need to compromise dog-locator function by requiring structure to distinguish between the recess, sleeve ends or casing collars as is performed in conventional tools.

Further, the prior BHA further comprises an axially-manipulated activation mandrel extending slidably through bore of the shifting tool conveyed downhole on the conveyance CT. The mandrel is connected downhole to the J-Slot Mandrel of an axially indexing J-SLOT. The J-Slot Housing is connected to a drag block.

The actuation portion of the shifting tool comprises the radially actuable arms supporting the profile-engaging dogs, radial arm biasing springs, an axially movable retaining ring for arm mode shifting and a dog locking cone. The activation mandrel is connected to the conveyance string for axial manipulation therewith. The activation mandrel can be tubular for selectable fluid communication therethrough: blocked, when performing treatment operations; and open, when moving the tool. The radially-actuable arms comprise three or more circumferentially spaced, and generally axially-extending arms bearing dogs at one end thereof.

The activation mandrel of the shifting tool is coupled to the J-Slot Mandrel.

A mode selector is coupled to the otherwise conventional J-SLOT, acting between a J-Slot Mandrel and J-Slot Housing to control the freedom of axial movement of the pin as it is indexed about in the J-Profile. In this context, the J-Profile is located circumferentially about the inside of the J-Slot Housing and the mandrel supports the pin or pins. In other embodiments, the pin could be located on the inner surface of the J-Slot housing and the J-profile formed in the J-Slot mandrel.

The mode selector retains unimpeded uphole and downhole movement for conventional shifting modes of the J-SLOT while enabling movement-restricting modes during other shifting operations.

Current Embodiments

As shown in FIG. 1, the shifting tool of the BHA is coupled to an otherwise conventional J-SLOT. The J-SLOT need not be modified. The mode selector is coupled to the J-SLOT.

The BHA operational shifting is coupled to a J-Slot Mandrel and pin of the J-SLOT, a J-Slot Housing and pin are selectively moveable axially relative to one another. In this embodiment, the J-Slot Housing supports the J-Slot profile or J-Profile for engaging the pin, the pin being supported by a J-Slot Mandrel operable through manipulation of the conveyance string.

A mode selector is provided for modifying the operation of the downhole J-SLOT and comprises a J-Slot Housing having a J-Profile having at least an uphole stop profile and a downhole stop. A J-Slot Mandrel extends axially along the J-Slot Housing and is movable axially therethrough, the J-Slot Mandrel having pin for following the J-Profile for shifting the operation of a connected BHA. A selector housing is coupled to the J-Slot Housing, and a selector mandrel extends axially along the selector housing and is coupled to the J-Slot Mandrel.

The selector mandrel permits the J-Slot Mandrel to move relative to the J-Slot Housing, or locks any relative motion therebetween. The mode selector further comprises a mode controller for controlling the axial movement of the selector mandrel within the selector housing between a free movement and a restrained movement wherein in the free movement, the pin moves substantially unimpeded along the J-Profile, and in the restrained movement, the pin is locked at a position along the J-Profile.

One embodiment of the mode controller is a hydraulic device acting between the selector mandrel and the selector housing. The hydraulic device can having a timing function, actions occurring before expiry of a threshold delay duration remaining free and action occurring after expiry of the threshold duration becoming locked.

J-SLOT manipulation that occurs after a prior indexing action, and that occurs within a duration less than a threshold delay time tD, retains a free movement operational mode. Should the delay timer expire, the duration being equal to or exceeding the tD, then the selector mandrel and connected J-Slot Mandrel is locked in that position until a further action is initiated to release the selector mandrel. This is useful where it is useful for the BHA to be pulled uphole while engaging a sleeve in the SET mode to close the sleeve without the otherwise usual cycling of its operation mode.

To resume usual free operation and cycling of the J-SLOT, the locked selector mandrel can be released. The locked selector mandrel can be released such as through time-release, a release force, or both.

Figure 2:
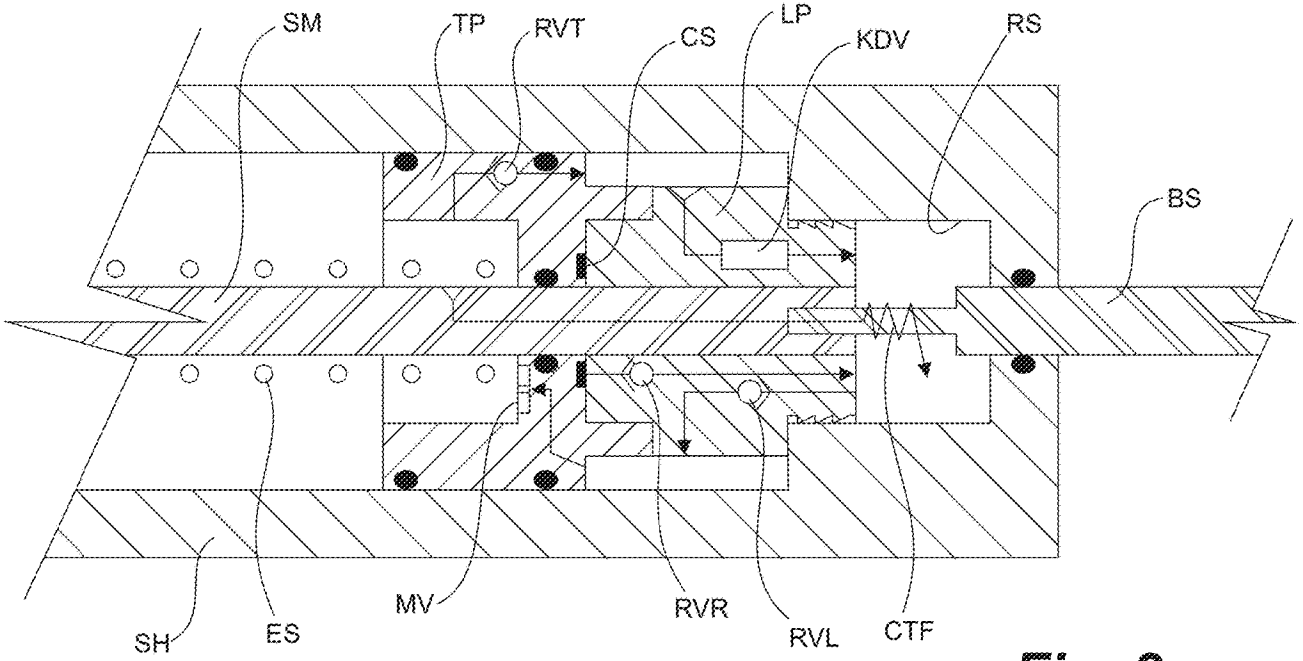
FIG. 2 is a simplified cross-section of one hydraulic implementation of the mode selector having a mandrel selectively axially operable relative to a housing, the housing and mandrel connected to relatively manipulated components of the downhole tool according to FIG. 1.

With reference to FIG. 2, the main components of the mode selector are the selector housing SH, which comprises a hydraulic cylinder, and the selector mandrel SM, which acts as a piston rod, and one or more pistons.

A travelling piston (TP) is sealable, and axially slidable, relative to the selector housing SH. Further the travelling piston TP is slidable along the selector mandrel SM.

A locking piston (LP) is located at a piston end of the selector mandrel. The locking piston LP is movable in a substantially un-restrained fashion when travelling downhole The travelling piston TP is movable along the selector housing between the locking piston LP and an uphole end of the selector housing. An engagement spring (ES) acts between the travelling piston and the uphole end of the selector housing. This spring is under compression to force the travelling piston TP to travel downhole when otherwise unconstrained and, given sufficient time, to contact and engage the locking piston LP. The travelling piston TP has two modes of movement, substantially un-restrained when travelling uphole and a retarded movement downhole, as urged by the engagement spring ES. Relatively unrestrained uphole movement of the travelling piston is enabled by a rapid one-way flow valve RFT for flow of uphole fluid downhole therethrough. Restricted downhole movement of the travelling piston is enabled by a metering orifice MV, retarding movement of the travelling piston TP as hydraulic fluid is forced through the metering orifice.

The selector mandrel SM, when actuated downhole, drives the connected locking piston LP, substantially unrestrained downhole into a receiving socket RS, or cylindrical chamber, at the downhole end of the selector housing.

Relatively unrestrained downhole movement of the locking piston LP is enabled by one or more one-way flow check valves RVL for flow of downhole fluid uphole therethrough. The rapid flow valve RVL permits fluid flow out of the receiving chamber as the locking piston LP enters.

The locking piston LP is not yet hydraulically locked to the receiving socket RS, until it is sealingly coupled with the travelling piston TP. Until the travelling piston is coupled to the locking piston, a rapid release valve RVR will permit easy withdrawal of the locking piston from the receiving socket, allowing fluid back into the receiving socket until blocked by an annular seal CS associated with the travelling piston.

The travelling piston TP is forced by the engagement spring ES towards the locking piston LP by downhole fluid travelling uphole through the metering orifice MV. This metering orifice provides a time metering device. Based on the timing of a usual fracturing operation at a sleeve valve, the metering orifice is sized for a timer, or threshold delay duration tD, of about 30 seconds, being longer than the time to perform the frac at that sleeve. The metering orifice MV and time can be adjustable, typically by adjustment or changing out before operations are initialized.

Again, until the travelling piston TP reaches the locking piston LP, the locking piston can be freely pulled to move uphole. Once the annular seal CS of the travelling piston blocks the rapid release valve RVR, the locking piston is hydraulically locked to the receiving socket as no fluid flows therein.

Flow via the travelling piston's check valves RVT enable rapid uphole compression of the engagement spring ES. Uphole movement of the travelling piston TP is only controlled by the compression of the ES in the uphole direction. In the downhole direction, the check valves RVT are locked closed forcing flow thru the metering orifice where it takes 30 seconds (adjustable) for the travelling piston TP to travel the entire distance from uphole to down hole where its locked to the locking piston LP and sealed thereto.

The travelling piston TP is ring sealed to an inner diameter ID of the outer barrel of the selector housing, so fluid can only travel slowly through the travelling piston TP via the metering orifice in the downhole direction and rapidly flow uphole to downhole through the one or more one-way check valves. The travelling piston TP has a timed engagement in the downhole direction and rapid unrestricted movement in the uphole direction. The travelling piston TP, when in contact with the locking piston is sealed thereto as a hydraulically coupled unit.

The locking piston LP is forced into receiving socket RS by the downhole movement of the selector mandrel and by engagement spring ES. The locking piston is also ring or lip sealed to the inner diameter of the receiving socket.

As stated, once the locking piston is sealably seated in the receiving socket, the selector mandrel is hydraulically locked thereto. The J-SLOT cannot cycle and movement of the conveyance string is locked to the BHA without cycling of the J-SLOT.

To resume free movement of the J-SLOT, a release is provided to de-couple the locking piston from the receiving socket. In one embodiment a kick down valve (KDV) is provided for communication between the selector housing cylinder uphole of the locking piston, and the receiving socket. The Kick down valve KDV hydraulically retains the locking piston in the receiving socket with enough retention force to permit the BHA to shift the sleeve, for example from an open to a closed position. An overload force will permit the valve to open for fluid flow therethrough and release the locking piston. The kick down valve KDV is set up with a delay reset. An example of a suitable kick down valve is a kick-down, pilot operated, balanced piston relief valve, Model RQCBLAN from Sun Hydraulics Corporation.

A secondary release of the locking piston from the receiving socket, is a bleed passage that slowly permits fluid to pass through the locking piston, the timing of which is longer than the sleeve shifting operations needed for the BHA. A metering orifice or more tortuous coiled timer fuse (CTF) or passage can be provided for extended delay before release is effected. The coil time Fuse CTF is a secondary release mechanism of the locking piston LP if not enough conveyance CT force is available to trigger the kick down valve KDV.

Upon initially applying a pull up on the conveyance CT, the selector housing and mandrel are locked together, however in one embodiment, with an increase in the force, greater than a threshold force FTH so as to activate the kick down valve KDV, the lock is released and the selector mandrel returns to free movement. Further, in another embodiment such as that using the coiled timing fuse, with an increase in the force that is less than the threshold force FTH, a release timer is initiated and when a release duration tR expires the lock is released and the selector mandrel returns to free movement.

The locking piston LP is housed and hydraulically locked in the receiving socket RS until the pull force on the selector mandrel exceeds the kick down valve KDV setting or the coil time fuse has expired.

The cylinder of the selector housing is oil-filled, comprising an atmospheric chamber along which the travelling piston TP and locking piston LP operate.

The selector mandrel is a shaft axially movable into and out of the uphole end of the selector housing. A downhole balancing shaft is also axially movable into and out of the downhole end of the selector housing and is coupled to the piston end of the selector mandrel. The selector and balancing shafts have about equal diameter and protruding both uphole and downhole from the selector housing, for pressure balance. The oil bath chamber inside the selector housing is at atmospheric pressure which requires the shaft seals at each end to exclude wellbore fluid pressures in operation.

The travelling and locking pistons TP,LP are also sealed at their outer diameters to the inner diameter of the selector housing and receiving socket respectively, namely: two seals between travelling piston TP and the barrel of the selector housing, an annular face seal between the downhole end of the travelling piston TP and the uphole end of the locking piston LP. Lip or cup seals can be provided for sealing between, and ease of entry, of the locking piston LP to the receiving socket RS.

In Detail

With reference to the Figures, and in more detail:

In FIG. 1 an embodiment with a downhole sleeve shifting tool is shown, the operation of which is controlled using a J-SLOT as modified with an embodiment of the current mode selector.

In FIG. 2, one hydraulic implementation of the mode selector is shown having the selector mandrel SM selectively axially operable relative to a selector housing SH, the housing and mandrel connected to relatively manipulated components of the shifting tool or FIG. 1.

Figure 3:
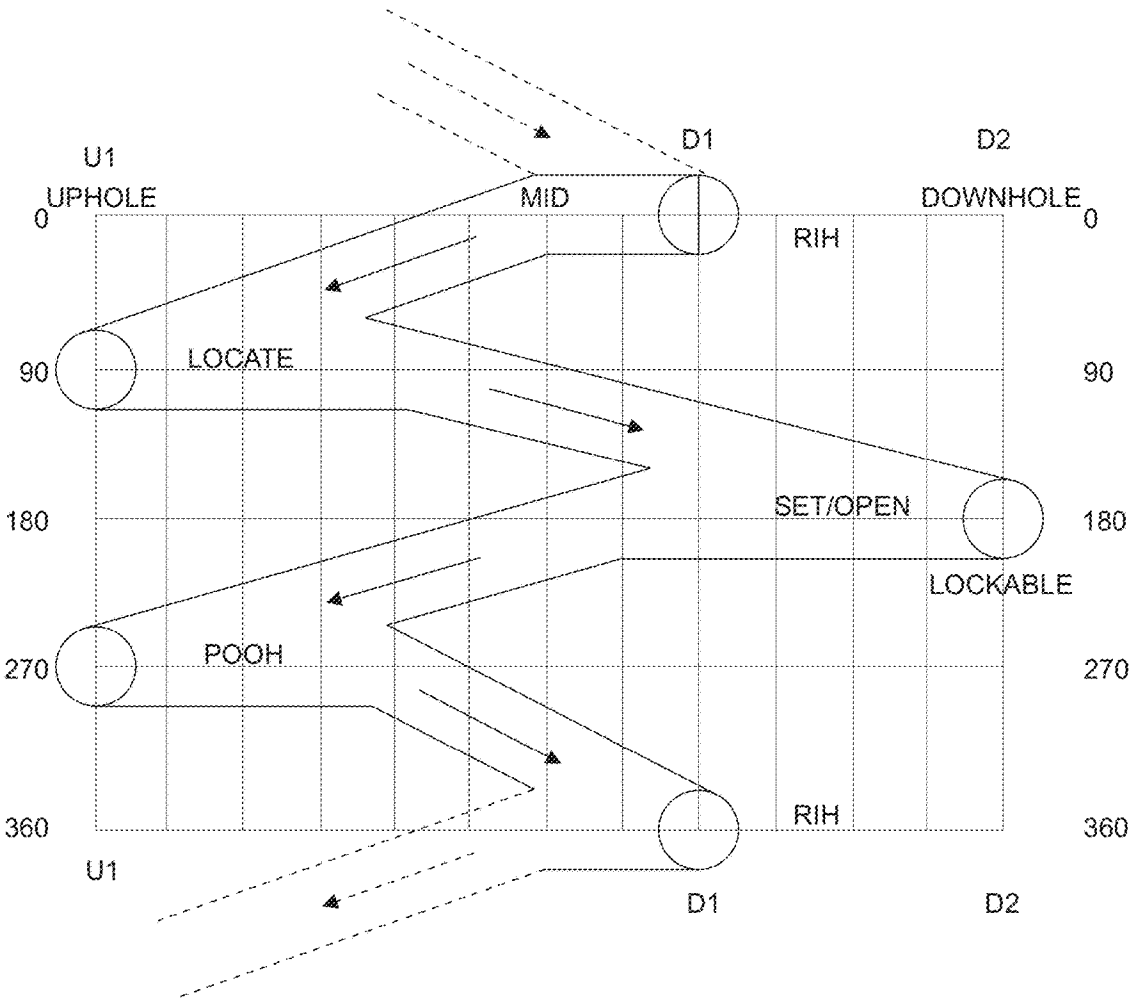
FIG. 3 is a rolled out representation of a J-Profile for a J-SLOT, the shifting of which is now selectable between free movement therealong and a restrained movement or lockable aspect.

FIG. 3 is a rolled out representation of a four-cycle J-Profile for a J-SLOT, the shifting of which is now selectable using the mode selector between free movement therealong and a restrained movement or lockable aspect in SET mode. Other different embodiments of downhole tools could have the lockable aspect actuable at different portions of the cycle and at different timing.

Figure 4A:
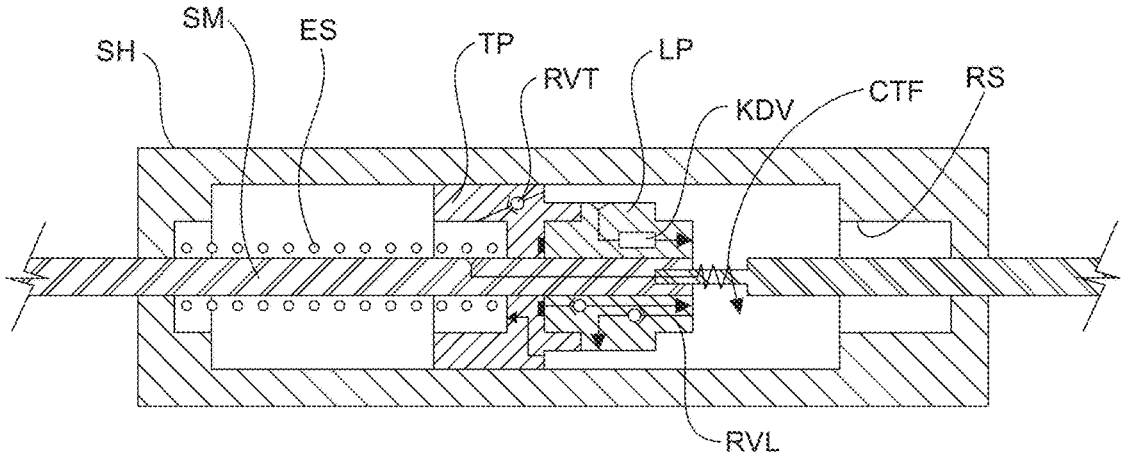
FIGS. 4A, 4B and 4C are schematic representations of a hydraulic mode selector of FIG. 2, illustrated in various free or locked modes of operation, more particularly.

FIG. 4A illustrates various free movement such as uphole movement during a POOH mode after release from the locked state. During the RIH mode, in which the travelling piston and piston are axially limited from reaching the receiving socket by the J-Profile, the travelling piston and locking piston are prevented from moving to the locking, receiving socket position.

Figure 4B:
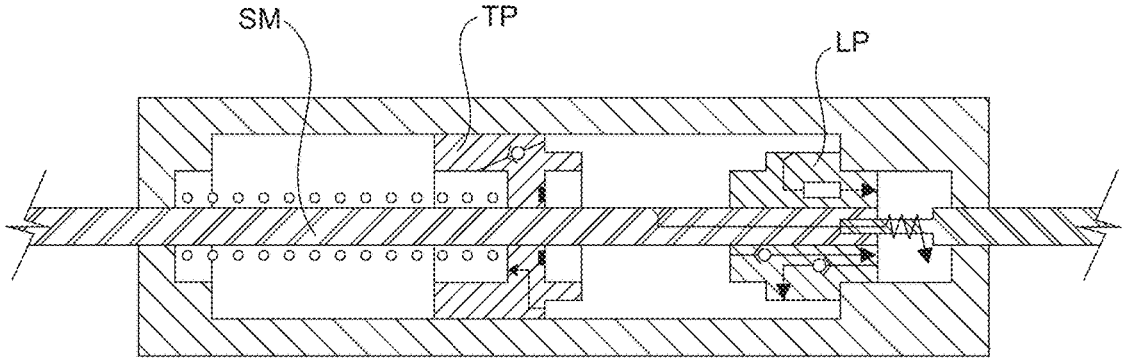

FIG. 4B illustrates initiation of a locking timer of the mode selector, until such time as the travelling piston sealingly engages the locking piston, the selector mandrel SM can be freely manipulated along the J-SLOT. The locking piston is shown engaged with the receiving socket, which in the present embodiment is only possible in the SET mode. The travelling piston TP is being slowing driven downhole by the engagement spring ES. Should the travelling piston TP reach the locking piston LP, the selector mandrel movement, and downhole tool associated therewith, is locked. Whether the movement is free or locked, is dependent on a time delay, tD and whether the BHA remains in the SET mode long enough to exceed the time delay.

Figure 4C:
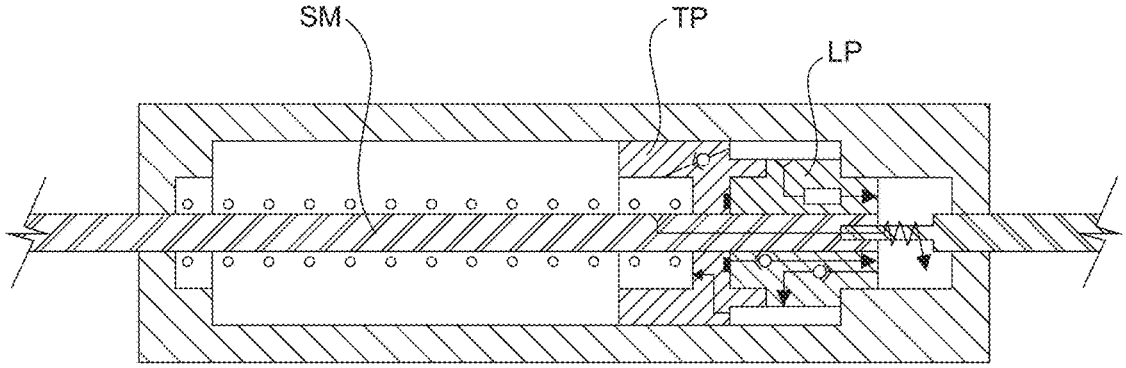
Figure 4C:
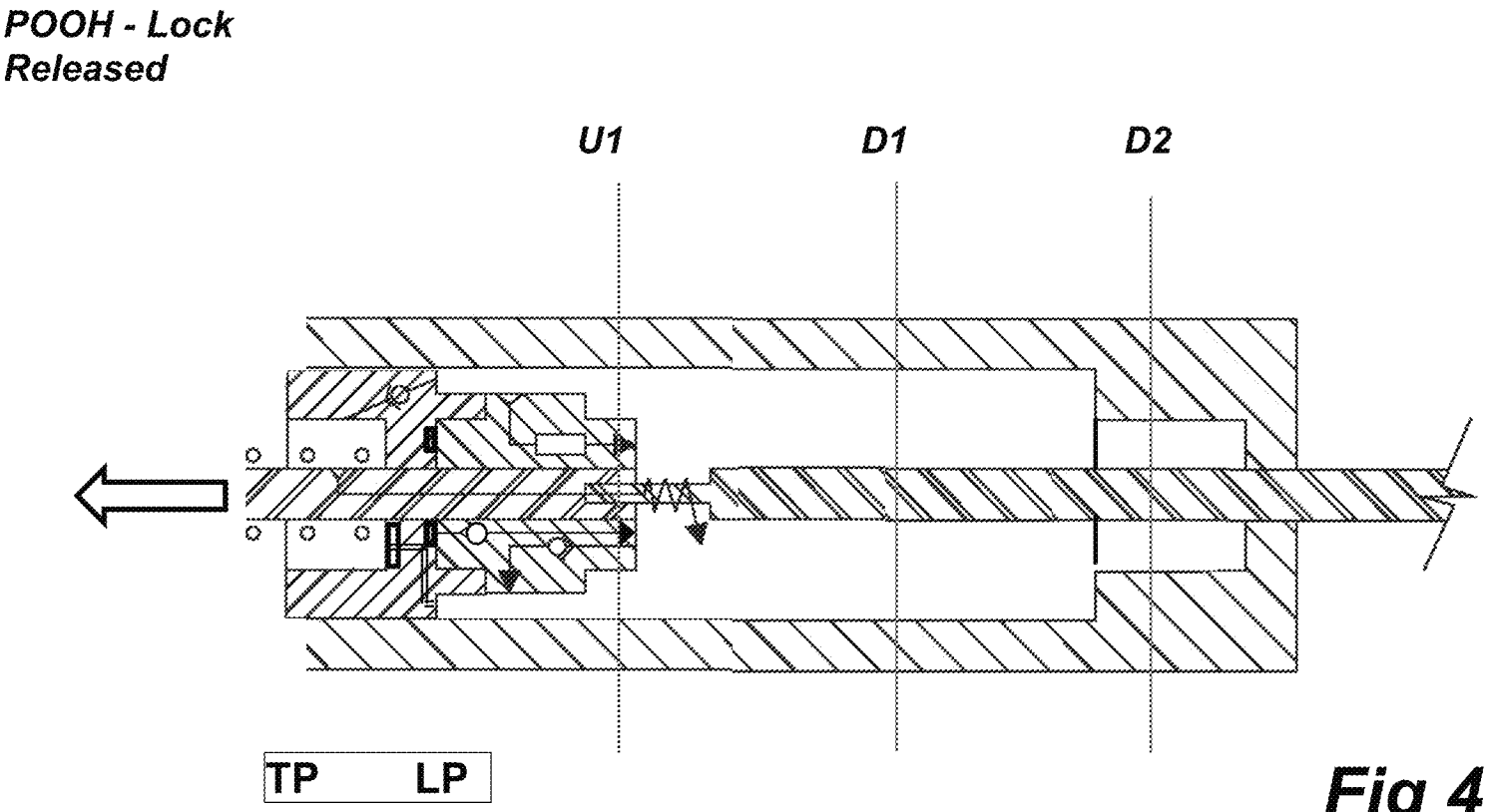
Figure 10A:
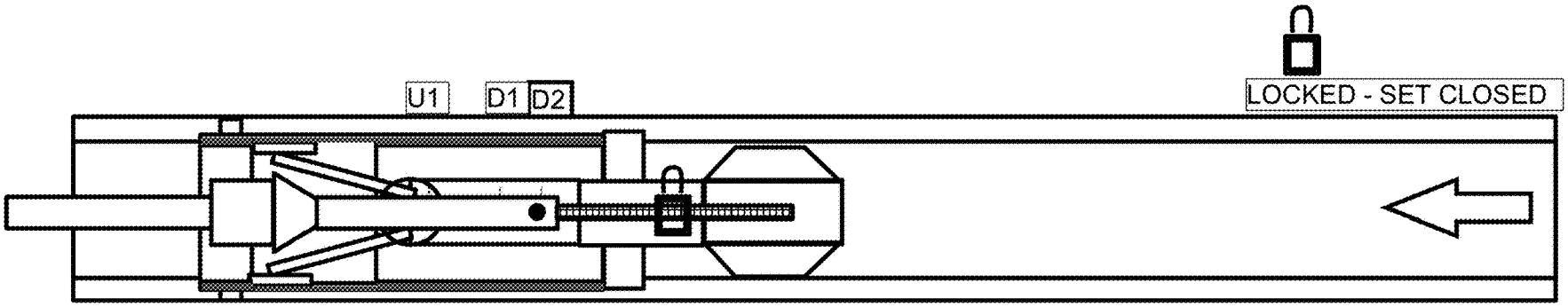
FIGS. 10A and 10B are schematic cross sections of the BHA according to FIG. 8A, the BHA illustrated as remaining in SET mode after locking of the mode selector for closing the sleeve, then releasing the mode selector to enable cycling of the J-SLOT to POOH mode for releasing the latches for repositioning the BHA to the next uphole sequential sleeve.

With reference to FIGS. 4C and 10A the selector mandrel locked to the selector housing.

With reference to FIGS. 4Ai and 8A, in RIH mode, which can take some time (for example, more than 30 sec) to reach the desired wellbore location or zone, the travelling piston TP has engaged the locking piston, but the J-Profile prevents the locking piston from reaching the receiving socket. Accordingly locking of the mode selector cannot occur.

In RIH mode, for all intents and purposes, the mode selector is ineffective. RIH with the BHA with or without the mode selector operationally is the same. The locking piston LP is connected directly to a shaft, the selector mandrel, that is connected to the J-SLOT. During RIH the J-SLOT is restricted by the "J-Profile to a position during RIH where the J-Slot Mandrel and the selector mandrel do not travel all the way downhole. For this reason the BHA latches or dogs are retracted and the locking piston unable to travel deep enough (J-Profile D1) to seat in the receiving socket RS, thus the mode selector is not engaged. The travelling piston TP however, during RIH mode, has enough time to seat against the locking piston LP. The now combined pistons TP,LP are freely moveable uphole through valve RVT and downhole through valve RVL. The sleeve in the sleeve valve remains in a closed position with the ports covered by the sleeve. The dogs or latches are radially retracted for movement along the wellbore casing.

Similarly in reference to FIGS. 4Aii, 8B and 8C, in LOCATE mode, which can take some time to reach the desired wellbore location or zone, the locking piston LP engages the travelling piston TP uphole and remote from the receiving socket RS. The uphole pull of the J-Slot Mandrel and the J-Profile spaces the locking piston LP from reaching the receiving socket. The combined pistons TP,LP are freely moveable uphole through fluid flow through valve RVT. The BHA latches have located and engaged the sleeve recess.

Again, when the BHA is in the LOCATE mode, the mode selector for all intents and purposes is rendered ineffective. Locating with the BHA with or without the mode selector is operationally the same. Again because the locking pison is connected directly to the J-SLOT, the locking piston LP, travelling from RIH to Locate in the J-SLOT sequencing, does not allow the mode selector to engage or change the operation of the BHA in any way. The spring ES simply travels back and forth with the movement of the travelling piston. The spring ES compression capability is adjustable, but for the purpose of this embodiment is set to a maximum compressive load of about 40 lbs and, when fully extended when it seats the TS against the locking piston LP, is about 20 lbs depending on where the locking piston is in the sequencing of the J-SLOT.

FIGS. 4Aiii and 8C illustrate the extent of the uphole movement of the coupled locking piston LP and travelling piston TP.

With reference to FIGS. 4Bi, and 9A, the conveyance string or CT and BHA is forced downhole to cycle the BHA to the SET mode and engage and shift the sleeve downhole for opening the ports for hydraulic fracturing of the formation at that stage. The locking piston LP is driven downhole with the selector mandrel. The selector mandrel is capable of moving downhole due to the freedom of axial movement of the J-Slot Mandrel in the SET mode of the J-Profile. The locking piston LP is also free to move downhole, independent of the travelling piston TP and moves without restriction due to flow clearance from the ID of the selector housing and also the valve RVL. The rapid flow valve RVL permits the locking piston to seat in the receiving socket and expel excess fluid therefrom. The travelling piston TP is left behind, uphole of the locking piston, due to the flow restrictive metering valve MV.

With reference to FIG. 4Bii, the travelling piston TP slowly makes its way downhole towards the locking piston due to the force applied by the compressed engagement spring ES and flow of fluid through metering orifice MV. This is the timing process for enabling free movement and operation of the J-SLOT prior to expiry of the delay threshold and locking of the selector mandrel after expiry of the delay threshold.

All the while, a hydraulic fracturing process can be proceeding through the open sleeve valve.

Indeed, with reference to FIGS. 4Biii and 9B if, prior to the delay threshold being reached, the CT is pulled uphole to actuate the BHA from SET to POOH, then the latches radially retract from the recess without BHA movement, and the BHA can then be pulled uphole to the next subsequent sleeve. As shown in FIG. 4Biv, the locking piston LP, not yet hydraulically locked in the receiving socket, pulls free of the receiving socket RS and catches the travelling piston TP.

In the alternate operation, such as to shift the BHA for closing the recently opened sleeve, and with reference to FIG. 4Ci, the operator continues to frac, or after hydraulic fracturing, waits for the delay threshold tD to expire, as shown by the coupling of the travelling piston and the locking piston while the locking piston remains in the receiving socket RS.

Part way into the frac (ie. <30 seconds in this example) the travelling piston TP is moving under spring ES force towards the locking piston LP. Nothing else is happening in the mode selector or the entire BHA string during this time, just the travelling piston LP moving internally downhole under spring ES force towards locking piston LP.

The oil-filled chamber is atmospheric pressure, so at well depth this chamber can be subject to significant crushing pressure from the wellbore fluids pressure. Also for this reason the seals and piston wiper rings function to keep pressure and fluid/contaminants out of the clean atmospheric oil-filled chamber. Although no, or very little, air will be in the atmospheric chamber is will still be vulnerable to pressure and minute inflow of fluid. Should seal friction becomes a problem under high pressure differential, one could pressure balance the atmospheric chamber to the wellbore fluid, using a compensating piston or other technical designs are available if required.

After expiry of the delay threshold, the mode selector has now been in SET mode long enough (ie. >30 sec) for the travelling piston TP to engage the locking piston LP and engage the seal face CS. The mode selector has been activated one can now close the sleeve immediately after the frac by pulling up on the CT. The latches of the BHA remain engaged with the sleeve, such that pulling up closes the sleeve.

Because the mode selector is engaged, the pistons TS and LP are hydraulically locked in the receiving socket RS and can only be pulled apart under force.

The annular seal of the travelling piston TP seals the rapid flow release valve RVR, hydraulically locking the locking piston to the receiving socket RS.

During the frac (ie. sitting in frac mode for longer than 30 seconds) the travelling piston TP has sufficient time to travel under spring ES force thru an atmospheric fluid chamber (which oil travels thru the TS via the metering orifice or vale MV) to the locking piston LP where it creates a face seal therebetween. As described below, once the travelling piston TP seals against the locking piston LP, they can be only separated by release in advanced of POOH mode available once one of several mechanisms are employed to release the travelling and locking pistons from the receiving socket RS.

The selector mandrel is now axially fixed relative to the J-Slot Housing meaning that any movement of the CT translates to movement of the BHA and engaged latches rather than a cycling of the J-SLOT. Thus, as shown in FIG.

4Cii and FIG. 10A upon pulling the CT uphole, the selector mandrel, selector housing, JJ-Slot housing and J-Slot Mandrel are shifted uphole. The BHA's engaged latches are pulled uphole to close the engaged sleeve while maintaining the J-SLOT in the SET mode.

Figure 10B:
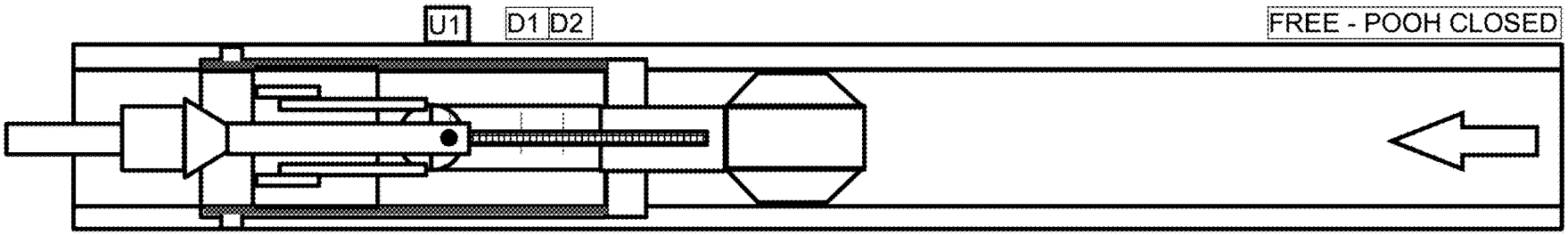

Thus, as shown in FIGS. 4Ciii, 4Civ and 4Cv and FIG. 10B, after the BJA operation is complete, in this case to close the sleeve, the J-Profile cycle to a POOH mode can be completed upon unlocking the selector mandrel. To unlock the locking piston from the receiving socket, the locking piston must be released hydraulically from the receiving socket for enabling free J-SLOT cycling. As described above, to resume free movement of the J-SLOT, a release is provided to de-couple the locking piston from the receiving socket.

In one embodiment a kick down valve (KDV) is provided for communication between the selector housing cylinder uphole of the locking piston, and the receiving socket. The kick down valve KDV forms a hydraulic block to retain the locking piston in the receiving socket with enough retention force to resist the pull force needed to enable the BHA to shift the sleeve to the closed position.

As shown in FIG. 4Civ, after an overload force is applied to the selector mandrel, the hydraulic pressure differential across the kick down valve KDV permits the valve to open for fluid through and release the locking piston LP from the receiving socket RS. A secondary release is provided in the case that insufficient pulling force can be provide so as to trigger the kick down valve. A bleed passage is provided to slowly permits fluid to pass through the locking piston, the timing of which is longer than the sleeve shifting operations needed for the BHA. The coiled timer fuse (CTF) provides an extended but eventual release.

As shown in FIGS. 4Civ and 4Cv, once released the selector mandrel with travelling piston and locking piston move uphole in the POOH mode, releasing the latches from the sleeve recess and permitting re-position of the BHA to the next subsequent uphole sleeve valve.

In other words, in the SET mode, the BHA dogs are in the set position and the mode selector is locked. After the frac, the pumps are shut down and the tool hand records the ISIP pressure, and he/she then immediately starts POOH mode. POOH mode immediately after ISIP, and the pistons TS and LP are hydraulically locked into the receiving socket RS, not allowing the J-SLOTto move. If the J-SLOT does not cycle, then the dogs are not permitted to disengage. Thus, at the BHA, the dogs stay engaged with the sleeve and pull it closed over the required closing detent force in the sleeve (in this case about 7 k daN). As the CT force is increased (in this case one could use 21 MPa as the KDV is adjustable) the internal pressure acting on hydraulically locking the MS valve increases. Force over a cross sectional area results in a pressure that acts directly on the kick down valve KDV.

To close a sleeve the closing detents retaining the valve in the actuated position is about 7 k daN. For the mode selector to close the sleeve it must to overcome the closing detent force, thus the release force can be set at about 10 k daN via the kick down valve KDV. This means when the CT exerts an uphole force in POOH mode greater than 7 k daN, the sleeve will close however the dogs will still not release from the sleeve.

As the POOH force increases from 8 to 10 k daN, then the kick down valve KDV activates dumping fluid from one side of the locking piston to the other side, releasing the hydraulic locking of the piston LP and allowing the J-SLOT to move from SET to POOH mode and the dogs under release from the sleeve. When this happens the weight indicator in the CT rig at surface sees a weight of 10 k daN, plus the CT string weight, drop to something just around CT string weight indicating the BHA is free from the sleeve.

The mode selector simply delays the shifting of the J-SLOT from SET to POOH. Once the BHA releases from the sleeve it is in POOH mode so one simply travels to the next subsequent sleeve uphole. The BHA is cycled to LOCATE mode below the next sleeve and the process is repeated.

The other way to release MS is in the event there is not enough string weight to overcome the closing detent load in the sleeve itself. In this situation one of two things could happen: the CT rig is unable to POOH hard enough to overcome string weight (+8 k daN), therefore the kick down valve KDV never opens. Backup release is simply holding load above string weight on the mode selector (ie. 2 k daN) where the fluid passes through the coil time fuse CTF, a flow restriction, until enough fluid has passed from one side of the locking piston to the other where it releases from the receiving socket RS and releases the BHA from the sleeve. This release time is based on what force is available between say 2 k daN and just under detent release 8 k daN. The less force available the more time it takes to release (e.g. 2 k daN, takes about 5 minutes in the present embodiment).

The sleeve could be defective (ie. closing detent requires more than 10 k daN) of force to close it. Thus an operator may need to pull 20 k daN of force on the BHA and mode selector to close the sleeve. The mode selector releases the BHA from the sleeve at the kick down valve KDV setting of 10 k daN. To resolve this problem in the well the operational procedure will resort back to Applicant's multi-cycle prior closing operation where the BHA can release from the sleeve in POOH mode, it is cycled below the sleeve, cycled again to locate mode, POOH mode locate the sleeve, pull it closed (ie. >20 k daN), SOFT-CYCLE to release and then POOH mode out of the sleeve.

In this embodiment, the mode selector is only activated/relevant in the SET mode, this being dependent on how long (ie. <30 sec OR >30 sec) the mode selector is sitting in the SET mode to activate it or not activate it.

In embodiment to re-open sleeves, the SET mode operation has an operational time of <30 sec. Further, one can re-close the sleeves after they are re-opened without having to travel to surface. After the entire wellbore has been frac'd, from toe to heel, opening and closing every stage immediately after the frac, the BHA is RIH again to the toe of the well in the same trip. At the toe of the well nothing changes in operation procedures to re-open the sleeve other than the set time is <30 sec. In re-opening the sleeves the set time is <30 sec. In fact when sitting in the control cabin the set time is around 20 seconds, because a reservoir pressure is recorded for that single stage. Because the set time is <30 sec the mode selector does not engage. The travelling piston TP does not have enough time to engage the locking piston LP to lock the inner selector mandrel. Because the mode selector is not engaged, immediately after the sleeve is re-opened, the CT is POOH and the BHA functions normally going directly to POOH mode, the J-SLOT functions from SET to POOH and the dogs immediately retract, releasing the BHA from the sleeve, leaving it in the open position.

If the reservoir stage pressure is high enough, the stage is left open to contribute flow/production to into the well bore. If the reservoir stage pressure is not high enough, it may be re-closed because it may not be able to contribute to the initial high pressure flow of the well. If the reservoir pressure is not high enough, simply wait >30 sec in the set mode (at the sleeve that was just re-opened) to allow the mode selector to activate/lock then cycle to POOH mode re-close the sleeve, again the mode selector providing added functionality and reducing CT cycles. Further as a safety fallback, releasing from the sleeve after it is re-closed is done by pulling above the 7 k daN force of the kick down valve KDV, or if exceeding the KDV force is not available, implementing the time delay with the CTF is available to release from the sleeve.

Figure 5A:
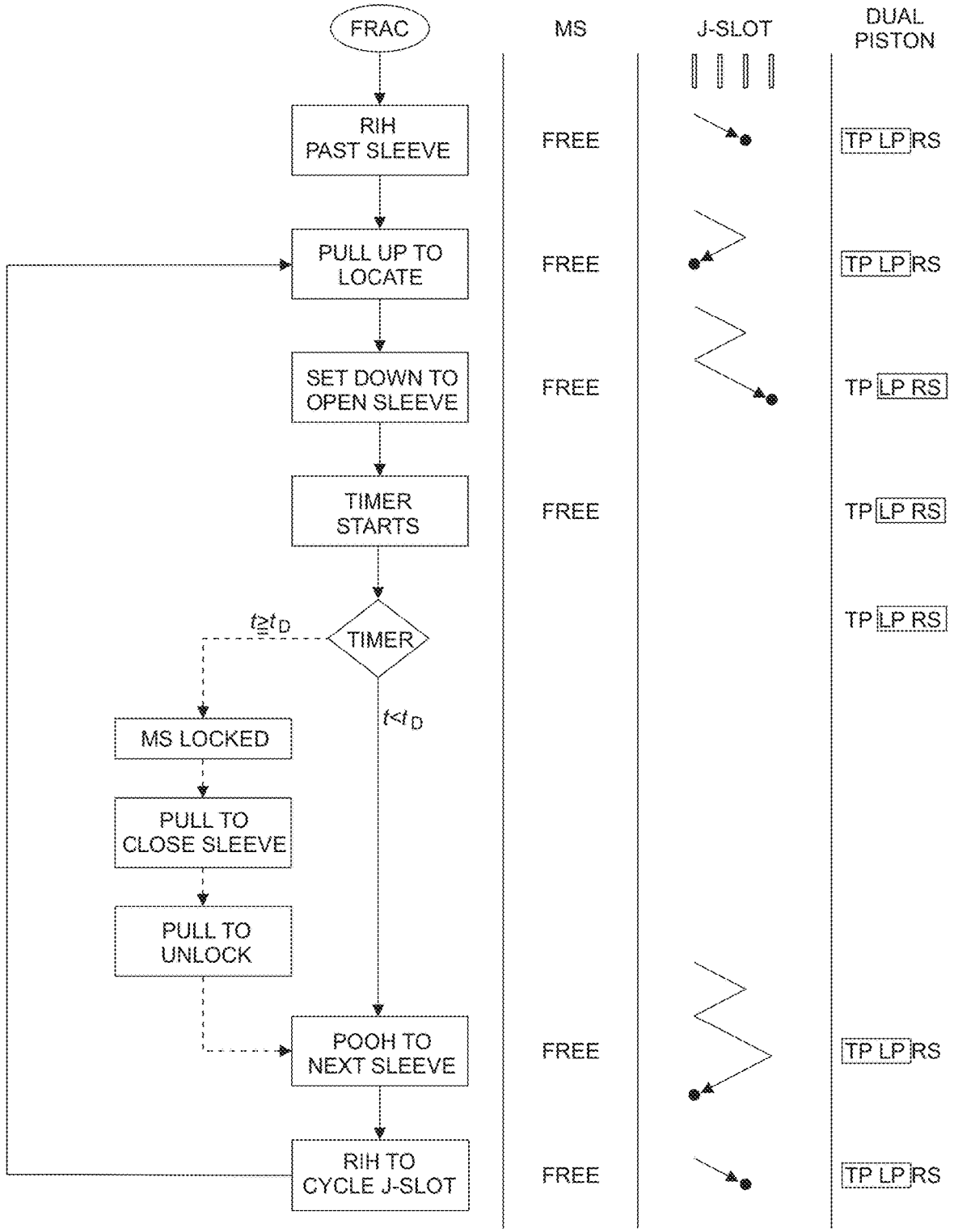
FIGS. 5A, 5B and 5C illustrate flow charts for a downhole shifting tool configured to engage the sleeve of downhole and uphole shiftable sleeve valves, more particularly.
Figure 5B:
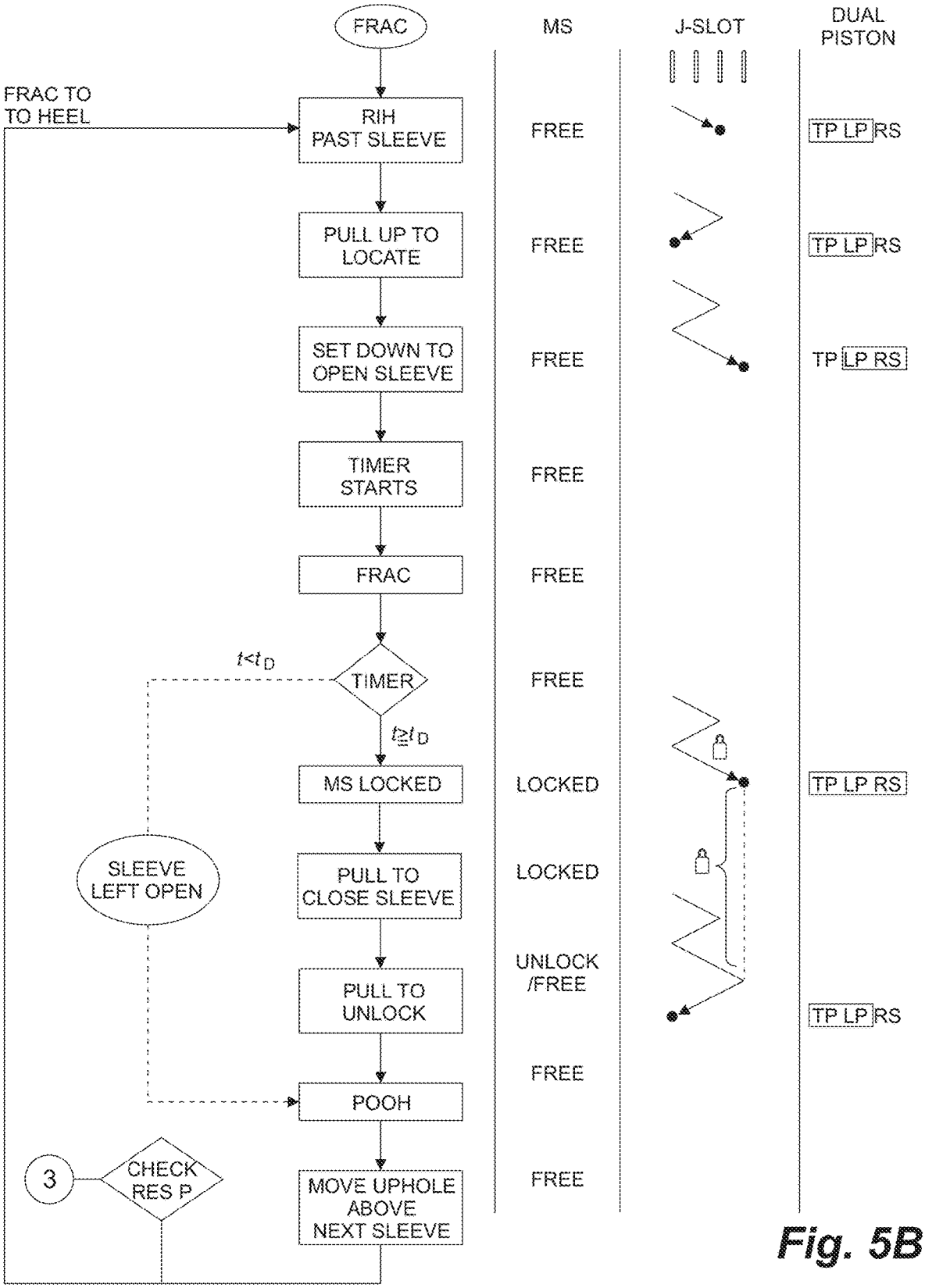
Figure 5C:
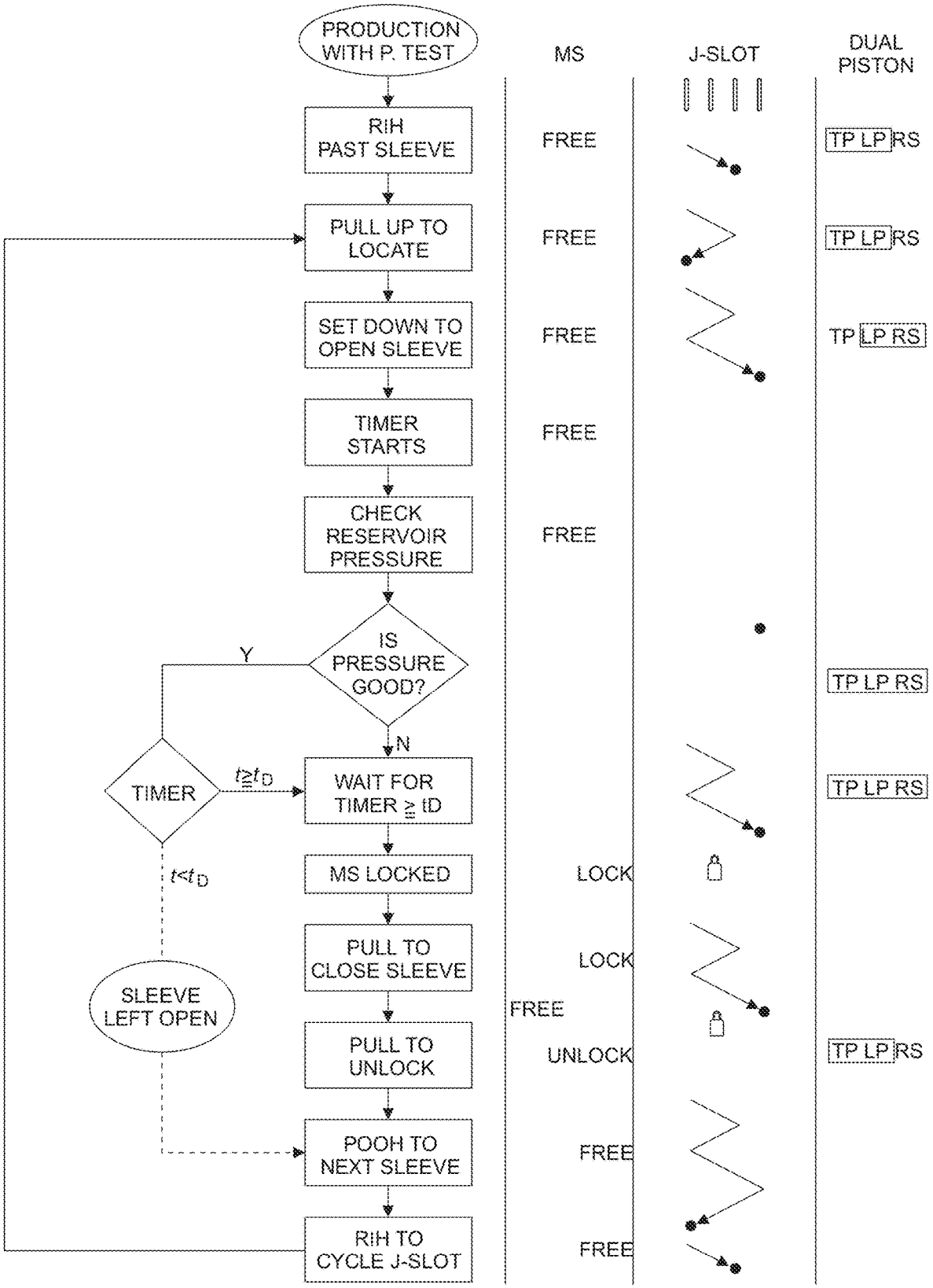
Figure 6A:
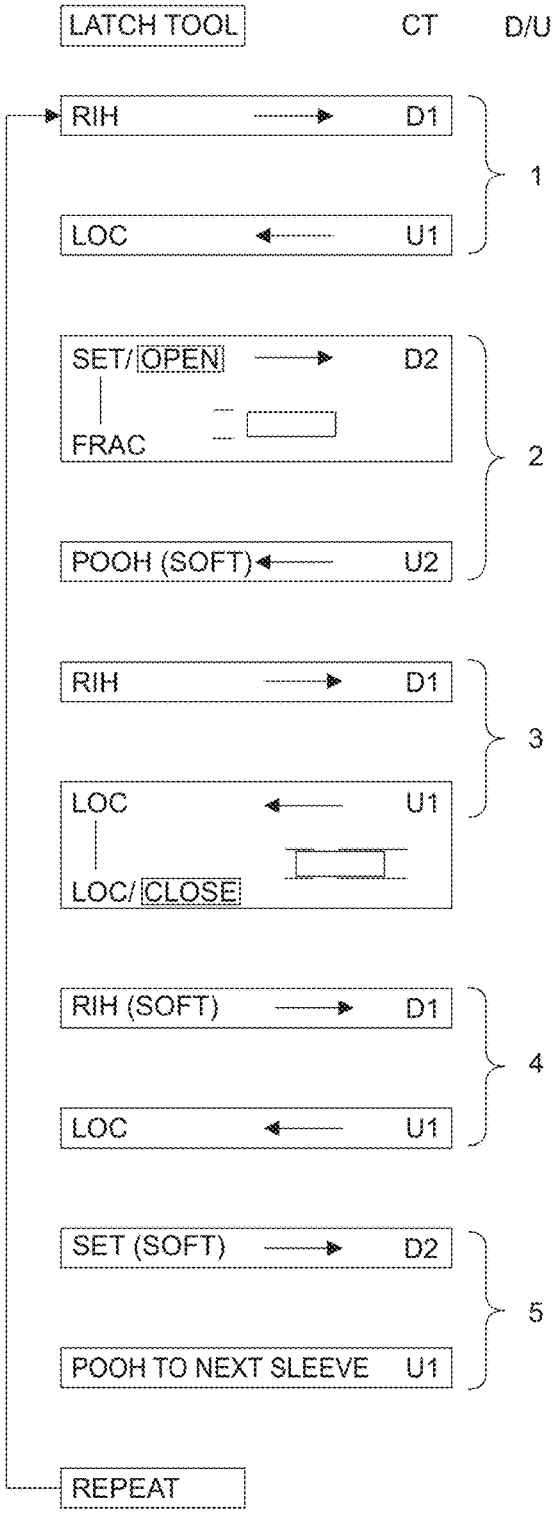
Fig. 6A PRIOR ART
FIG. 6A is a flow chart of the multiplicity of CT cycles required for a BHA of the PRIOR ART to open, close and re-position to a next sequential sleeve.
Figure 7A:
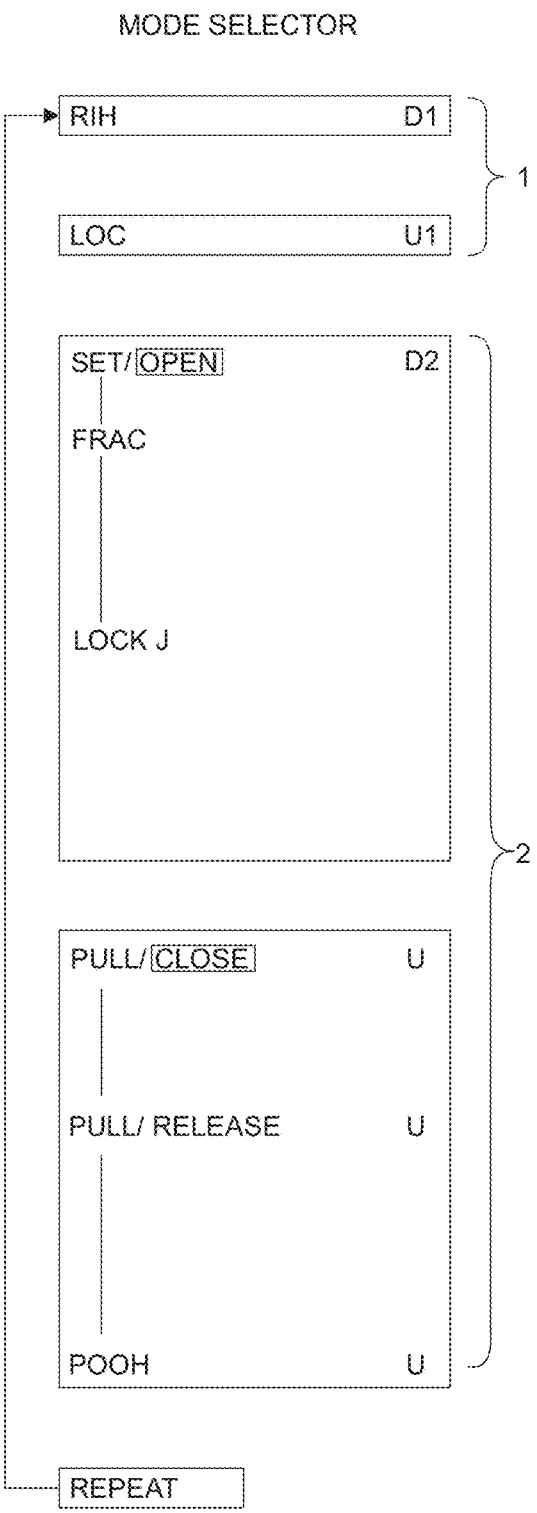
FIG. 7A is a flow chart of a reduced number of CT cycles required for the same BHA, equipped with a mode selector, to open, close and re-position to a next sequential sleeve.
Figure 8A:
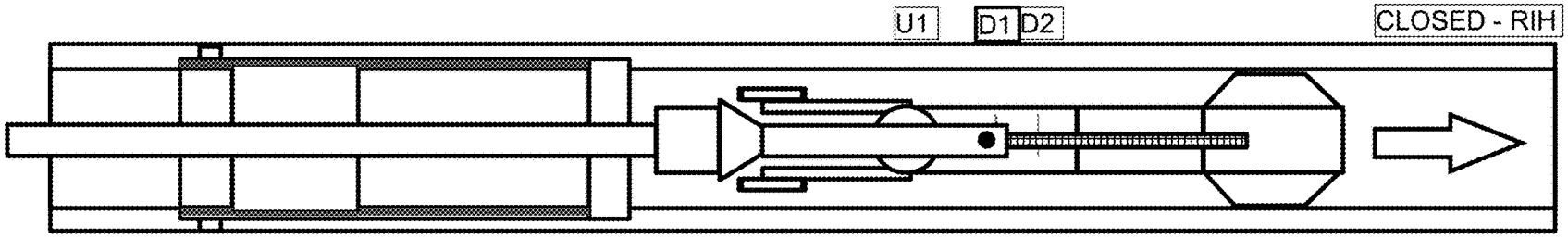
FIGS. 8A through 8C are schematic cross sections of a BHA, J-SLOT, a mode selector and a drag block arranged at one sleeve valve of a completion string, the BHA illustrated in RIH mode, cycling the J-SLOT to LOCATE mode, and after the latches have located the sleeve recess respectively.
Figure 8B:
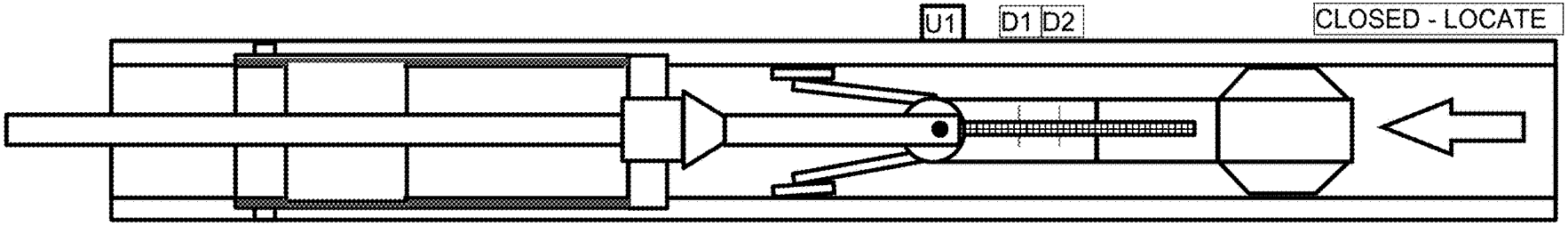
Figure 8C:
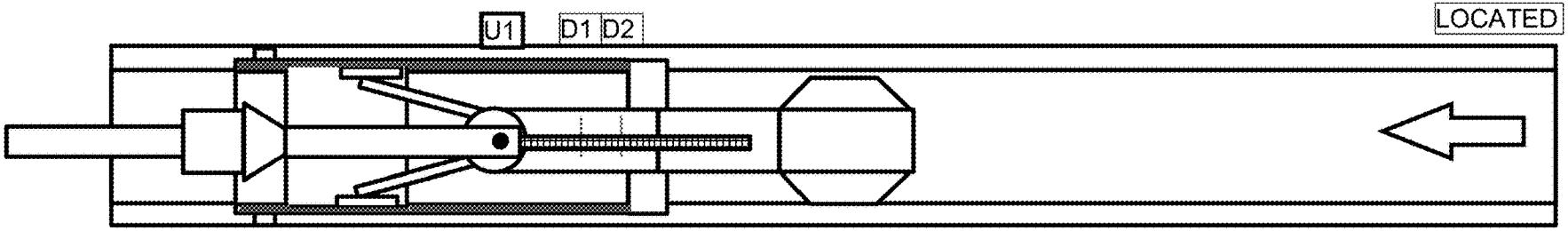
Figure 9A:
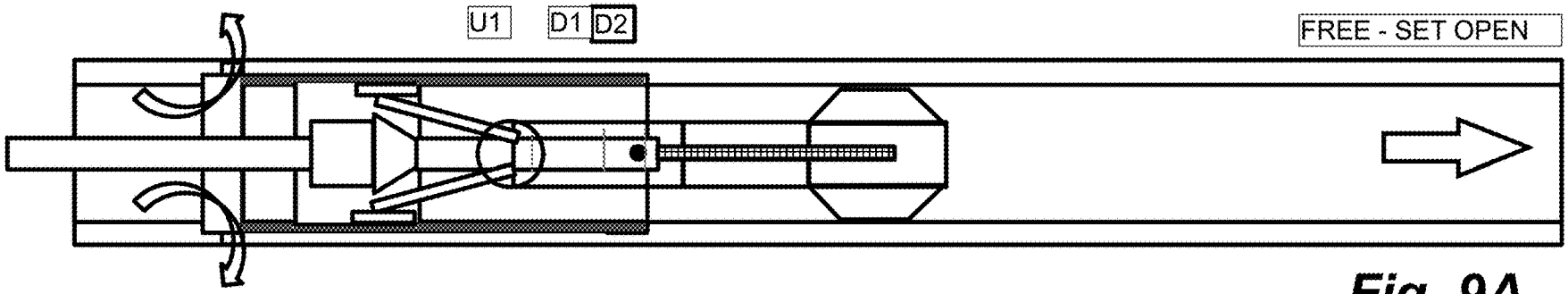
FIGS. 9A and 9B are schematic cross sections of the BHA according to FIG. 8A, the BHA illustrated in SET mode for opening the sleeve and fracing through the opened ports, and an optional cycle to a SOFT-POOH mode for releasing the latches for repositioning the BHA to the next uphole sequential sleeve.
Figure 9B:
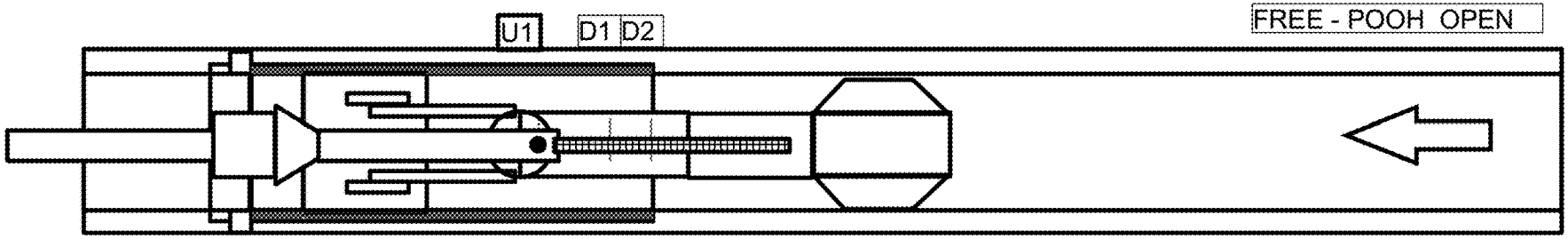
Figure 11A:
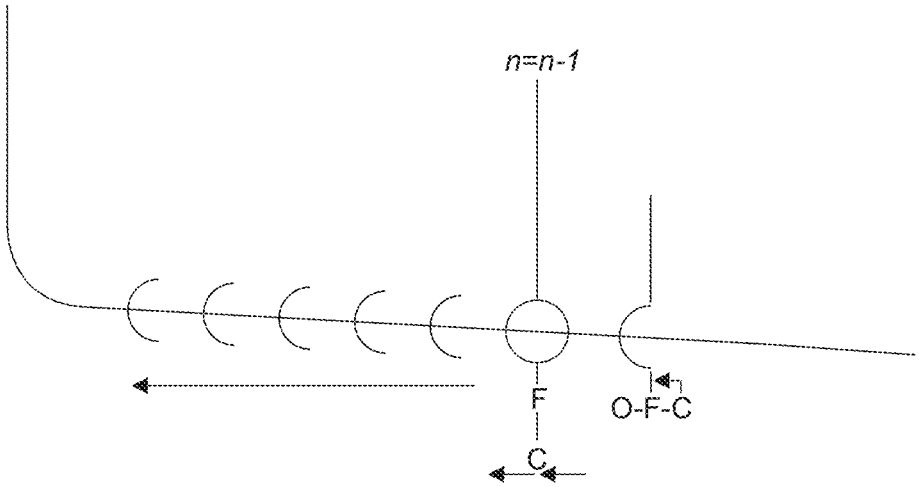
FIGS. 11A through 11C illustrate various hydraulic fracturing operations now possible using a mode selectors couples with a sliding sleeve shifting tool, including.
Figure 11B:
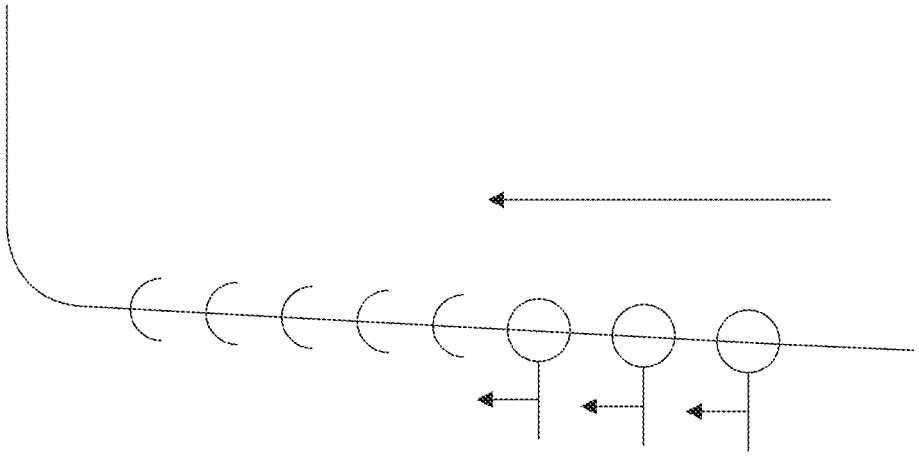

FIGS. 5A, 5B and 5C illustrate flow charts for a downhole shifting tool configured to engage the sleeve of downhole and uphole shiftable sleeve valves, more particularly:

FIG. 5A illustrates the steps for selecting a J-SLOT operation for the downhole tool, firstly for running in hole (RIH), pulling uphole to locate a sleeve, setting down to open the located sleeve and, before the mode selector time delay expires, pulling up again to move the downhole tool uphole to the next sleeve valve;

FIG. 5B illustrates the steps for selecting a J-SLOT operation for running in hole (RIH), pulling uphole to locate a sleeve, setting down to open the located sleeve and, after the mode selector time delay expires to lock the J-SLOT, pulling up again to close the previously-opened sleeve, then releasing the mode selector to permit the J-SLOT to shift the downhole tool uphole to the next sleeve valve;

FIG. 5C illustrates the steps for selecting a J-SLOT operation for running in hole (RIH), pulling uphole to locate a sleeve, setting down to open the located sleeve and, performing a pressure test with the sleeve open, thereafter if the production pressure from that zone is acceptable and before the mode selector time delay expires, pulling up again to move the downhole tool uphole to the next sleeve valve or, if the pressure is not acceptable then, after the mode selector time delay expires, pulling up again to close the previously opened sleeve to block the bad zone;

FIG. 6A is a flow chart of the multiplicity of CT cycles required for a prior art BHA to open, close and re-position to a next sequential sleeve;

FIG. 7 is a flow chart of a reduced number of CT cycles required for the same BHA, equipped with a mode selector, to open, close and re-position to a next sequential sleeve;

As stated, and as shown in FIG. 11A, in more recent operations, an operator is interested in closing the open sleeve valve after fracturing to permit the fractured formation to rest or heal. The operator opens frac all the stages from the toe to the heel, and closing each stage after the frac then, as shown in FIG. 11B, the operator travels from the heel to the toe and starts re-opening sleeves.

Figure 11C:
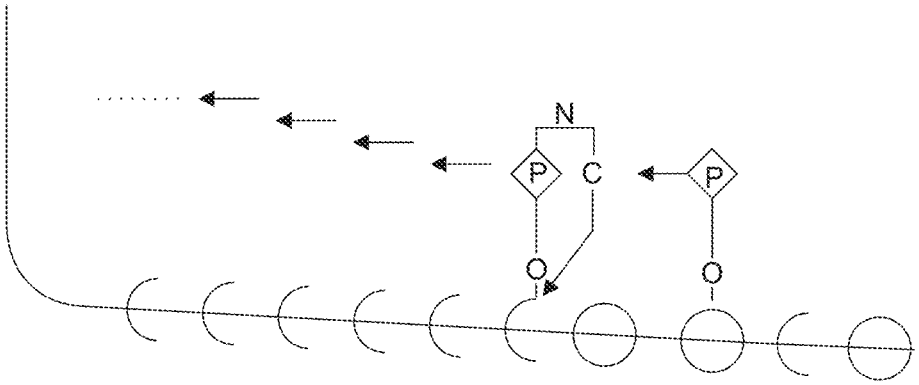

As shown in FIGS. 5C and 11C, when re-opening sleeves, because the stages below the stage being opened, a specific reservoir pressure can be read at that stage, and if that particular stage pressure is not sufficient (or even if on vacuum) to contribute to initial flow it can be reclosed. One can re-open the sleeve after the frac to measure the reservoir pressure at that stage with the rest of the entire well isolated. The stages above the stage being opened are closed and the open stages below the stage being opened are isolated by the BHA. The element in the BHA isolates the reservoir pressure to come out of the well and pressurize the well to surface giving the oil company the pore pressure available by that stage and only that stage.

Such information is valuable, as: if the stage pressure is high that is desirable and the oil company wants to know this because they can cross correlate this information to their drilling logs and make an assessment on that rock geology or geomechanics with respect to production capability; if the stage pressure is very low or if that stage is on vacuum, not only is this data point helpful in understanding the geology or geomechanics of the reservoir at that point, the stage pressure may be/is the deciding factor to leave that stage open or closed. What oil companies are now doing is closing that stage if the reservoir pressure is to low, because if the rest of the well is higher pressure, rather than oil or gas flowing to surface it will simply cross flow in the horizontal section to a lower pressured stage, this is lost production at least early on in the well.

As the horizontal well gets older, and the mean average wellbore pressure decreases, the lower pressured closed stages can be reopened and contribute to overall production rather than being over pressured and being a thief of production from the well; and reduces CT cycling cost. Cycling CT fatigues it, reducing cycling reduces the wearing out of CT faster and prolongs life to being able to frac more wells with one string of CT. Further, re closing a sleeve after it has been re-opened ahs heretofore not been accomplished.

FIGS. 11A through 11CD illustrate various hydraulic fracturing operations now possible using a mode selectors couples with a sliding sleeve shifting tool, including:

FIG. 11A illustrates running the shifting tool to the toe and configuring the mode selector for performing sequential operations of opening a sleeve, fracturing the zone and closing the sleeve before moving uphole, such operations permitting healing of the fractured zones before production;

FIG. 11B illustrates running the shifting tool to the toe and configuring the mode selector for performing sequential operations of opening each sleeve before moving uphole, such operations permitting configuring previously fractured zones for production; and FIG. 11C illustrates running the shifting tool to the toe and configuring the mode selector for performing sequential operations of opening each sleeve before moving uphole, checking for formation pressure performance from that zone and closing non-performers.

Electronic Actuation of Mode Selector

Figure 12A:
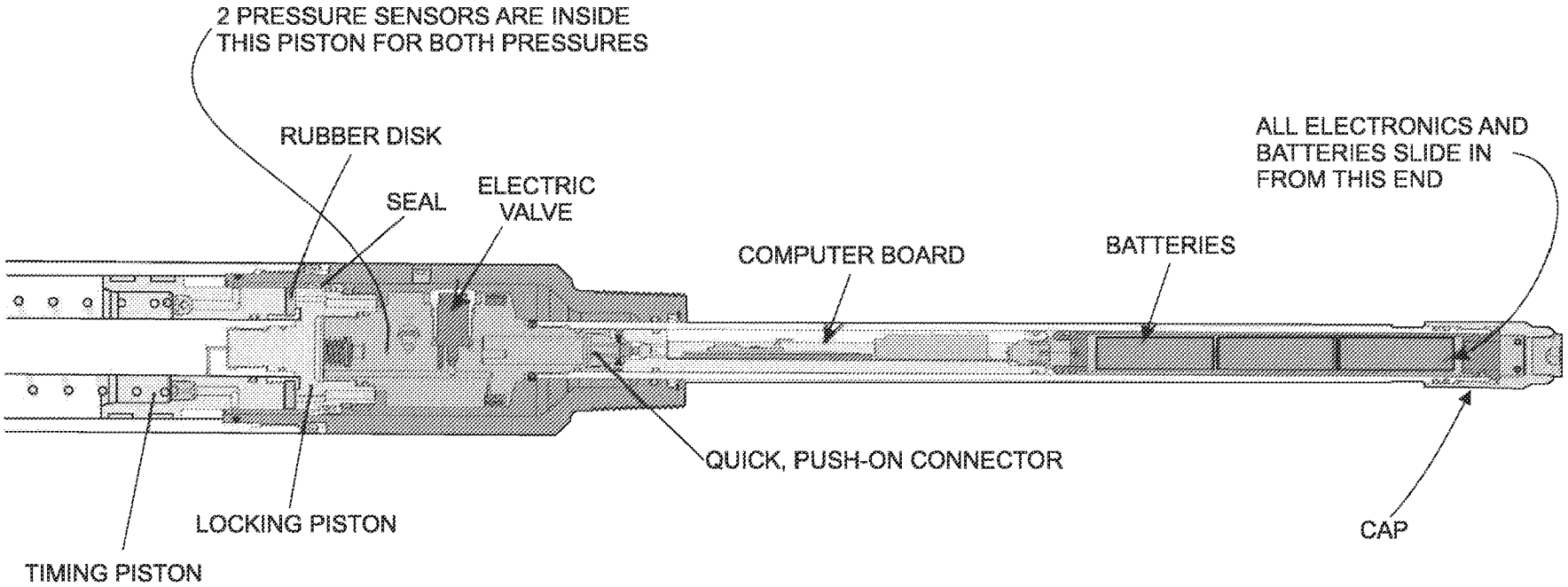
FIG. 12A illustrates an embodiment of a mode selector having electronically actuated valves and associated electronic components.

In embodiments, with reference to FIG. 12A, the mode selector can be electronically actuated, such that operation of the mode selector does not purely rely on mechanical and hydraulic valves. In such embodiments, the mode selector can be controlled by a computer and one or more electronically controlled valves replacing one or more valves of the travelling piston and locking piston. Pressure sensors can be located inside the travelling and/or locking piston to monitor pressure on both sides of the pistons. Electronic components such as circuitry, batteries, and the like can be located within the balancing shaft and sealed from wellbore fluids and pressure. The computer can be programmed with the threshold delay time to open and close the electronically controlled valves accordingly to lock the selector mandrel and prevent the J-mechanism of the BHA from being cycled to the next mode, and release the selector mandrel to the free mode upon the fulfillment of pre-set conditions, e.g. the exceeding of a pre-determined CT pull force, exceeding of a pre-determined CT pull force for a specified period of time, or the lowering of CT string tension.

Figure 12B:
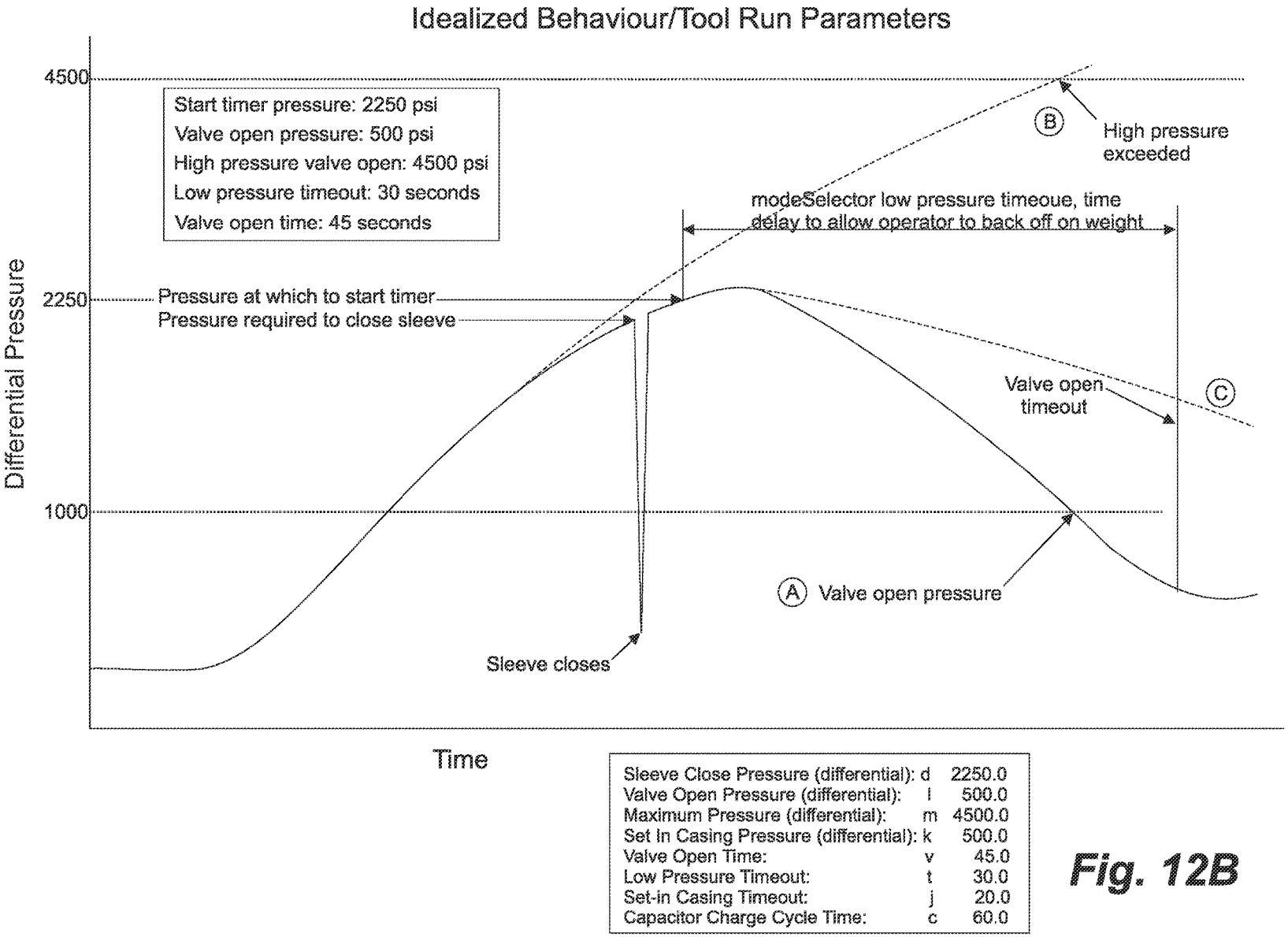
FIG. 12B depicts a graph of the differential pressures across the locking piston at which the computer of the mode selector of FIG. 12A releases the selector mandrel.

The computer can also be configured to monitor the pressures on both sides of the travelling piston and/or locking piston to determine the state of the mode selector. FIG. 12B depicts the logic for releasing the mode selector in an embodiment. Once the operator pulls the sleeve closed with the mode selector locked and the BHA locked in the SET mode, the computer will release the mode selector to the free mode if certain conditions are met, for example:

a. after the sleeve has been pulled uphole to the closed position, the tension on the CT reduced, and the mode selector is released at about 1000 psi on the way down;

b. if the operator pulls on the CT such that the pistons exceed a threshold pressure;

c. if the operator pulls on the CT at above a predetermined force for longer than a specified period of time, then the computer releases the mode selector. The timer can begin after the sleeve has been closed, determined at surface from a change in CT string tension or differential pressure on the piston.

As one of skill in the art would understand, the computer can be programmed to lock or release the selector mandrel according to a variety of other conditions.

We claim:

1. A J-Slot mechanism mode selector for a downhole tool comprising:

a J-Slot housing having a J-Profile having at least an uphole stop and a downhole stop;

a J-Slot mandrel extending axially along the J-Slot housing and movable axially therethrough, the J-Slot mandrel having a pin for following the J-Profile;

a selector housing coupled to the J-Slot housing, and a selector mandrel extending axially along the selector housing and coupled to the J-Slot mandrel; and a mode controller for controlling the axial movement of the selector mandrel within the selector housing between a free movement setting and a restrained movement setting wherein in the free movement setting, the pin moves substantially unimpeded along the J-Profile;

in the restrained movement setting, the pin is locked in a position along the J-Profile; and the mode controller has a time delay between the free movement setting and the retrained movement setting.

2. A J-Slot mechanism mode selector for a downhole tool conveyed on a conveyance string comprising:

a J-Slot housing adapted for coupling the mode selector to the downhole tool, the J-Slot housing having a J-Profile having at least an uphole stop and a downhole stop; and a J-Slot mandrel connected to the downhole tool and operable with the conveyance string and extending axially along the J-Slot housing, the J-Slot mandrel having a pin for following the J-Profile;

a selector housing coupled to the J-Slot housing, and a selector mandrel extending axially along the selector housing and coupled to the J-Slot mandrel; and a mode controller for controlling the axial movement of the selector mandrel within the selector housing between a free movement setting and a restrained movement setting wherein in the free movement setting, the pin moves substantially unimpeded along the J-Profile;

in the restrained movement setting, the pin is locked in a position along the J-Profile; and the mode controller retrains the movement of the selector mandrel where the downhole tool has been shifted to a second operating position for a time duration exceeding a delay threshold.

3. The mode selector of the claim 2, wherein:

the downhole tool is in a wellbore and shiftable between at least two operating positions, and when the selector mandrel is in the free movement setting, the downhole tool is shiftable between the at least two operating positions; and the selector mandrel is in the restrained movement setting, the downhole tool is movable in the wellbore without shifting operating positions.

4. A J-Slot mechanism mode selector for a downhole tool comprising:

a J-Slot housing adapted for coupling to the downhole tool, the J-Slot housing having a J-Profile having at least an uphole stop and a downhole stop; and a J-Slot mandrel extending axially along the J-Slot housing, the J-Slot mandrel having a pin for following the J-Profile;

a selector housing coupled to the J-Slot housing, and a selector mandrel extending axially along the J-Slot housing and coupled to the J-Slot mandrel; and a mode controller for controlling the axial movement of the selector mandrel, between a substantially unimpeded setting and a restrained movement of coupled J-Slot mandrel setting;

wherein the selector mandrel further comprises a piston sealably movable along the selector housing for hydraulic control between the substantially unimpeded setting and the restrained movement of a coupled J-Slot mandrel setting.

5. The mode selector of claim 4, wherein the piston further comprises:

a first fluid control for substantially unimpeded movement of the travelling piston and selector mandrel along the selector housing, and a second fluid control for restrained movement of the travelling piston, locking piston and selector mandrel along the selector housing.

6. The mode selector of claim 5 wherein the second fluid control further comprises a hydraulic release wherein upon the expiry of a holding interval, namely, the delayed reset of a kick down valve or coiled timer fuse, movement of the piston and selector mandrel along the selector housing is released for substantially unimpeded movement.

7. The mode selector of claim 5 wherein the mode controller further comprises a third fluid control for delaying actuation of the second fluid control for a delay interval, during which substantially unimpeded mandrel and pin actuation is maintained.

8. A downhole tool comprising an indexing tool comprising a J-Slot housing having a J-Profile having at least an uphole stop and a downhole stop;

a J-Slot mandrel extending axially along the J-Slot housing, and having a J-slot pin, the pin movable axially along the J-Profile;

a mode tool comprising a selector housing coupled to the J-Slot housing;

a selector mandrel coupled to the J-Slot mandrel and having a piston secured thereto and sealably movable along the selector housing; and a fluid controller for controlling a flow of fluid between an uphole chamber, uphole of the piston and a downhole chamber, downhole of the piston, the mode tool having a first fluid control comprising a one way valve in a travelling piston between the uphole and downhole chambers for substantially unimpeded selector mandrel and coupled pin actuation along the J-Profile, and a second fluid control comprising a locking piston sealingly coupled to the travelling piston locked in to a receiving socket between the uphole and downhole chambers for locking mandrel actuation for a holding interval wherein the movement of the selector mandrel and coupled pin along the J-Profile is temporarily restrained.

9. The downhole tool of claim 8 wherein the selector mandrel and housing further comprise a delay timer acting after actuation of the first fluid control and before actuation of the second fluid control, wherein the second fluid control remains unlocked for a delay interval.

10. The downhole tool of claim 8 wherein the fluid controller further comprises a third fluid control comprising an engagement spring biasing the travelling piston for delaying locking of the second fluid control for a delay interval, during which substantially unimpeded mandrel and pin actuation is maintained.

11. The downhole tool of claim 8 wherein the second fluid control further comprises a hydraulic release comprising a kick down valve or coiled timer fuse for flowing fluid between the uphole and downhole chambers upon the expiry of kick down valve, or during timed bleed of the coiled timer fuse, the holding interval wherein the restraint of the movement of the selector mandrel and coupled pin along the J-Profile is released.

12. The downhole tool of claim 8 wherein the selector housing further comprises a barrel and a receiving socket, the receiving socket closing the downhole chamber;

the piston has a travelling portion sealably slideable along the selector mandrel and a downhole locking piston secured axially to the selector mandrel, the locking piston releasably engageable at an uphole end with the travelling portion, the travelling and locking pistons independently movable along the barrel, and the locking piston sealingly and releaseably engageable with the receiving socket portion, wherein when the locking piston is disengaged from the receiving socket, the selector mandrel and pin actuation are substantially unimpeded; and when the locking piston is engaged with the receiving socket, the movement of the selector mandrel and pin actuation are locked.

* * * * *